US009357835B2

(12) United States Patent
Krasnick

(10) Patent No.: US 9,357,835 B2
(45) **Date of Patent: *Jun. 7, 2016**

(54) TRANSVERSAL CLEANING APPARATUS

(71) Applicant: Harry Krasnick, Denpassar (ID)

(72) Inventor: Harry Krasnick, Denpassar (ID)

( * ) Notice: Subject to any disclaimer, the term of this patent is extended or adjusted under 35 U.S.C. 154(b) by 0 days.

This patent is subject to a terminal disclaimer.

(21) Appl. No.: 14/639,371

(22) Filed: Mar. 5, 2015

(65) Prior Publication Data

US 2015/0173503 A1 Jun. 25, 2015

Related U.S. Application Data

(63) Continuation of application No. 13/892,966, filed on May 13, 2013, now Pat. No. 8,997,298.

(51) Int. Cl.

| | |
|---|---|
| ***A46B 9/04*** | (2006.01) |
| ***A47L 13/12*** | (2006.01) |
| ***A47L 13/20*** | (2006.01) |
| ***A46B 5/00*** | (2006.01) |
| ***A46B 9/02*** | (2006.01) |
| ***A46B 15/00*** | (2006.01) |
| *A47K 7/02* | (2006.01) |
| *A47K 11/10* | (2006.01) |

(52) U.S. Cl.

CPC ..... *A46B 9/045* (2013.01); *A46B 5/002* (2013.01); *A46B 5/0004* (2013.01); *A46B 5/0066* (2013.01); *A46B 9/02* (2013.01); *A46B 15/0055* (2013.01); *A47K 7/028* (2013.01); *A47L 13/12* (2013.01); *A47L 13/20* (2013.01); *A46B 2200/1006* (2013.01); *A46B 2200/1086* (2013.01); *A47K 7/02* (2013.01); *A47K 11/10* (2013.01); *Y10T 29/49826* (2015.01); *Y10T 29/49904* (2015.01)

(58) Field of Classification Search

CPC .... A46B 9/045; A46B 5/0004; A46B 5/0008; A46B 5/0012

See application file for complete search history.

(56) References Cited

U.S. PATENT DOCUMENTS

| | | | | |
|---|---|---|---|---|
| 6,588,956 | B1 * | 7/2003 | Gennuso, Jr. | A47L 13/20 15/144.1 |
| 7,549,186 | B2 * | 6/2009 | Geiberger | A46B 7/06 15/167.1 |
| 8,997,298 | B2 * | 4/2015 | Krasnick | A46B 5/0066 15/159.1 |
| 2003/0088933 | A1 * | 5/2003 | Woods | A46B 5/00 15/167.1 |

* cited by examiner

*Primary Examiner* — Laura C Guidotti

(74) *Attorney, Agent, or Firm* — Rigel J Menard

(57) ABSTRACT

Apparatuses and methods of using and making apparatuses that may clean concave and convex surfaces are discussed. The apparatus may be capable of substantially contacting and cleaning concave, convex, planar, and non-planar surfaces.

18 Claims, 16 Drawing Sheets

TRANSVERSAL CLEANING APPARATUS

This application is a continuation of application Ser. No. 13/892,966 Transversal Cleaning Apparatus filed on 05/13/2013 and claims priority to application Ser. No. 13/892,966, the contents of which is hereby incorporated by reference herein.

TECHNICAL FIELD

This disclosure generally relates to cleaning apparatuses, and in particular, to transversal cleaning apparatuses. More particularly, it pertains to transversal apparatuses for cleaning the oral cavity or recess.

BACKGROUND

Longitudinally-oriented (e.g., monoaxial) toothbrushes may present difficulties in employing certain brushing methods. At least one of these methods includes positioning bristle tips of a brush at a particular angle to a surface to be cleaned, pressing the bristle tips against the gingiva, vibrating the bristles, and moving the bristles in small circular motions. This method, and similar methods, may present obstacles for individuals with lesser manual dexterity, such as the young, the elderly, or the physically challenged. Many users consequently resort to using a side-to-side scrubbing action, in which the bristle tips of the toothbrush do not penetrate in-between the teeth effectively or under the gumline. Such brushing techniques can cause loss of tooth enamel and damage to the gingiva or palatal tissues.

Although transversal toothbrushes can offer one or more advantages over monoaxial toothbrushes, cleaning the anterior lingual dental surfaces with some transversal toothbrushes may be difficult because the curve of the dental arch may cause the ends of the cleaning head to contact teeth adjacent to those to be cleaned. Previous remedies include providing a concave bristle profile, which renders the cleaning head unsuitable for cleaning concave dental surfaces; providing a double-ended transversal toothbrush with a convex-shaped cleaning head at one end and a concave-shaped head at the other, which may entail interrupting the brushing process to reverse the orientation of the toothbrush during brushing; and reducing the width of the cleaning head to a degree that may substantially reduce other advantages sought in the transversal configuration. The transversal toothbrush of EP0900033B, to Grivon and Hugon, has a curved handle and a brush head that can be manually adjusted between transversal and coaxial orientations to the longitudinal axis of the apparatus. The longitudinal toothbrush of U.S. Pat. No. 2,266,195, to Hallock, has a central head portion that is resilient and can move relative to the surrounding portion of the cleaning head to enable the entirety of the bristles to contact both convex and concave surfaces. The toothbrush of U.S. Pat. No. 2,232,269, to Reuben, has a pair of parallel necks one of which can be manually rotated so that its brush head is perpendicular to the other brush head. Cleaning apparatuses having a cleaning head longitudinal axis oriented substantially perpendicular to the longitudinal axis of the apparatus may have a cleaning head that is substantially rigid.

SUMMARY

An example of a cleaning apparatus can include a handle comprising a first handle portion, at least two individual neck elements, wherein the at least two individual neck elements each include a first neck end and a second neck end opposite the first neck end, and wherein the second neck ends of the at least two individual neck elements are coupled to the first handle portion. The apparatus can include a composite cleaning head comprising at least two individual cleaning heads, wherein each of the individual cleaning heads includes a proximal portion connected to the first neck end of a one of the at least two individual neck elements and an opposing distal portion, wherein each of the individual cleaning heads includes at least one cleaning tool coupled to its bottom side, and wherein at least one of the cleaning tools of each individual cleaning head includes at least one of bristles, fibers, hair, filaments, wires, wool, abrasive material, pads, sponges, and a combination thereof, and wherein the composite cleaning head is configured to deform responsively and reversibly along its longitudinal plane in response to pressure applied in the direction of a surface to be cleaned, such that the cleaning tools sufficiently contact concave, convex, and other non-planar surfaces.

A method of manufacturing a cleaning apparatus configured to facilitate cleaning both planar and non-planar surfaces can include coupling each of at least two individual cleaning heads to one of at least two individual neck elements, wherein the at least two individual cleaning heads and the corresponding individual neck elements are coupled between an individual cleaning head proximal portion and an individual neck element first end, and coupling at least one cleaning tool to the bottom side of each of the individual cleaning heads. The method can include coupling each individual neck element second end of the at least two individual neck elements to a first portion of a handle, wherein the individual cleaning heads are arranged in lateral adjacent relationship to form a composite cleaning head having a longitudinal axis substantially perpendicular to a longitudinal apparatus axis.

DETAILED DESCRIPTION

Figure 1:
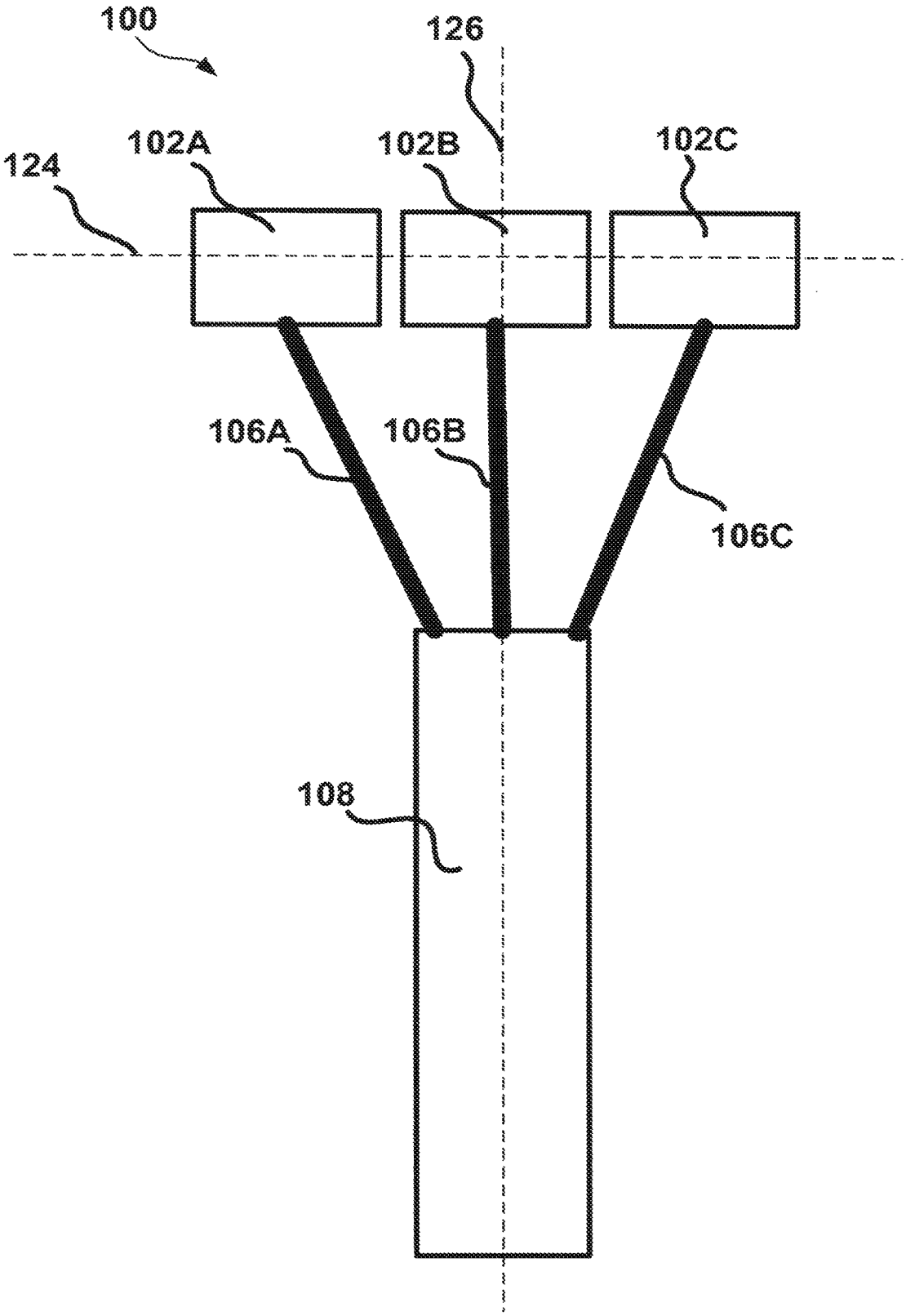
FIG. 1 is a top view diagram of an example of a transversal cleaning apparatus.

In the following description, reference is made to the accompanying drawings that form a part hereof. The drawings are illustrations of examples of embodiments that may be practiced. These embodiments are described in sufficient detail to enable those skilled in the art to practice the subject matter of the disclosure, and it is to be understood that other embodiments may be utilized and that structural changes may be made without departing from the scope of the present disclosure. The following description of example embodiments is, therefore, not to be taken in a limited sense, and the scope of the present disclosure is defined by the appended claims.

Transversal toothbrushes may make lesser demands on the shoulder muscles than some non-transversal toothbrushes because positioning the cleaning head parallel to the rows of the teeth may not require raising the upper arm nearly as much as when using a monoaxial toothbrush. The lesser degree of muscular exertion required may decrease the impulse to cease cleaning before the task has been completed. In addition, the comparatively difficult task of repetitive ulnar-radial and radial-ulnar rotation of the wrist and forearm when cleaning the contralateral teeth, the mandibular teeth, and the buccal surfaces thereof, may be reduced or even eliminated when compared to using a monoaxial toothbrush. Cleaning the interdental spaces and at the gumline may be accomplished more easily and effectively with a transversal toothbrush because of the potentially greater ease in executing the comparatively fine muscular movements. These advantages may also be realized when brushing the teeth of another person or an animal with a transversal brush. Similar advantages can be realized when using a transversal cleaning apparatus to clean surfaces other than teeth.

An advantage of a transversal cleaning apparatus discussed herein, such as a toothbrush, includes a cleaning apparatus whose cleaning head can responsively and reversibly adapt for cleaning convex, concave, and irregular planar surfaces in addition to substantially flat surfaces. Such an advantage can be provided without interrupting the process of cleaning surfaces of different topographies.

An apparatus having a composite cleaning head that responsively and reversibly deforms along its longitudinal plane when brought into contact with concave, convex, and other non-planar surfaces, including but not limited to planar surfaces having protrusions or other irregular features, is discussed herein.

Cleaning various types of surfaces may be enhanced through use of a transversal cleaning apparatus that may facilitate the cleaning of concave, convex, planar and other non-planar surfaces. In one or more embodiments, a transversal cleaning apparatus may include a composite cleaning head comprising multiple individual cleaning heads coupled to multiple individual neck elements that may be coupled to a handle. In one or more embodiments, cleaning heads, neck elements, and the handle may be provided with means to allow the cleaning heads to be substantially mobile to facilitate contacting many varied surface shapes while simultaneously sufficiently stable or controllable to facilitate the cleansing of the surface contacted.

FIG. 1 shows a top view diagram of an example of a cleaning apparatus 100. The cleaning apparatus 100 may include cleaning heads 102A-C, neck elements 106A-C, and a handle 108. The neck elements 106A-C, may be coupled to cleaning heads 102A-C, respectively. The handle 108 may be coupled to neck elements 106A-C. The handle 108 or neck elements 106A-C may have one or more curves. The curves of the neck elements 106A-C may be similar to one another, complementary, or substantially opposite to one another, or may resemble or be opposite or complementary to optional curves in the handle 108.

Cleaning heads 102A-C may be arranged adjacent to one another along a longitudinal composite cleaning head axis 124. The longitudinal composite cleaning head axis 124 may be substantially perpendicular to a longitudinal apparatus axis 126. As used herein, a composite cleaning head means a plurality of individual cleaning heads 102 and cleaning head means an individual cleaning head. The composite cleaning head can include three cleaning heads 102A-C. In one or more embodiments, the number of cleaning heads 102 is greater or less than three. The individual cleaning heads 102 may be of the same size as each other or may differ; their shape may be substantially identical or different. The bodies of individual cleaning heads 102 may be of unitary construction or, alternatively, may comprise left-hand and right-hand constituent elements, or upper and lower constituent elements, that are affixedly joined together to form an individual cleaning head body 102. Such two-piece cleaning head bodies 102 comprising two constituents may offer advantages over unitary individual cleaning head bodies 102 in the manufacturing process or in other ways.

The cleaning apparatus 100 may include means for facilitating a composite cleaning head to responsively and reversibly conform to non-planar and planar surfaces, including but not limited to concave and convex surfaces, as well as planar surfaces having protrusions, depressions, or other irregular features.

Neck elements 106A-C may have a variable degree of flexibility. For example, at least one neck element 106 may include some flexibility, may be substantially rigid, or may comprise a combination of flexible and rigid portions. In one or more embodiments, neck elements 106A-C may be substantially flexible (e.g., elastomeric). In other embodiments, neck elements 106A-C are substantially rigid. In yet other embodiments, neck element 106B is substantially rigid, while neck elements 106A and 106C are elastomeric (e.g., made from a flexible material). In yet other embodiments, neck elements 106A and 106C are substantially rigid while neck element 106B is substantially flexible. The neck element 106 may be flexible enough to facilitate cleaning heads conforming to planar, concave, convex, and other non-planar surfaces. Other combinations of flexible and substantially rigid neck elements 106 are possible and may have advantages in particular usage contexts. At least one longitudinal neck element axis may be substantially parallel with the longitudinal apparatus axis 126, such as neck element 106B shown in FIG. 1. In one or more embodiments, neck element 106B may be substantially coaxial with the longitudinal apparatus axis 126.

Handle 108 may allow a user to hold the cleaning apparatus. Handle 108 may be substantially elongate and may include at least one curve or be substantially straight. The handle can be of varying lengths and may be substantially longer than depicted in FIG. 1. Handle 108 may have a substantially uniform thickness or diameter, or a non-uniform thickness, wherein one or more portions are thicker than other portions of the handle 108. The handle 108 may include curves to facilitate user access to surfaces that would otherwise be difficult to reach. In the example of a toothbrush, the handle 108 may include curves or non-uniform thicknesses that may enable a user brushing their own or another person's teeth to substantially avoid the handle 108 contacting the chin or being positioned uncomfortably close to the chin. The handle 108 may have one or more of a hilt, a pommel, or finger grooving. The handle 108 may be non-elongate. The handle 108 may also be provided with an extension configured to permit the user's forearm to help to steady the apparatus. The handle 108 can include a flattened portion or a concave portion configured for placement of a user's thumb.

The handle 108 can be substantially short so as to permit a user to grasp the handle 108 in the volar portion (e.g., palm) of the user's hand. Such an implementation can include a handle 108 that is about an inch or more shorter than the normal handle length. The end of the handle 108 opposing the end of the apparatus that includes the cleaning heads 102 can be rounded or blunt so that the handle 108 does not hurt a user when using the apparatus in this manner. Such a configuration can increase the maximum power that can be exerted without much, if any, loss of precision. Such a configuration can work synergistically with a user looping a finger over the intersection of two necks elements 106.

Figure 2:
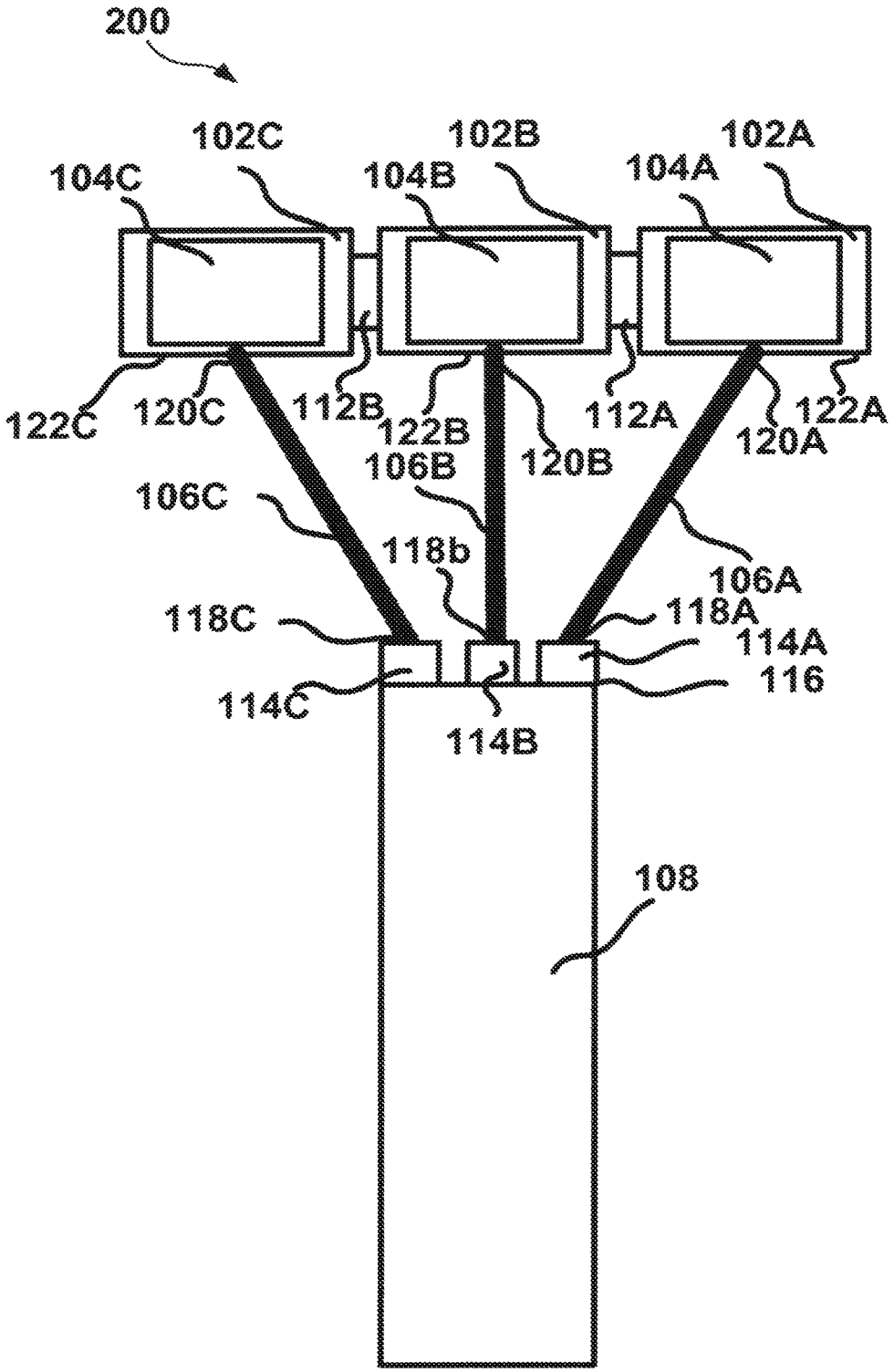
FIG. 2 is a bottom view diagram of an example of a transversal cleaning apparatus.

FIG. 2 is a bottom view diagram of an example of a cleaning apparatus 200. The cleaning apparatus 200 can be configured for cleaning the human body, such as teeth or external surfaces of the human body, or for cleaning broad surfaces. Cleaning apparatus 200 may include cleaning heads 102A-C, cleaning tools 104A-C, neck elements 106A-C, and a handle 108. The cleaning apparatus 200 may optionally include cleaning head connectors 112A and 112B disposed between cleaning heads 102A and 102B, and 102B and 102C, respectively. The cleaning head connectors 112A-112B can be flexible or resilient or may be a type of flexible hinge. The cleaning apparatus 200 may optionally include handle connectors 114A-C coupled between the handle 108 and the neck elements 106A-C, respectively. The handle connectors 114A-C may be flexible or resilient or may be a type of flexible hinge.

The cleaning apparatus 200 may include cleaning heads 102A-C. The cleaning heads 102A-C can include a cleaning tool 104A-C disposed on the bottom portion thereof. The cleaning heads 102A and 102B, and 102B and 102C may be coupled by optional flexible cleaning head connectors 112A and 112B, respectively. The cleaning head connectors 112A-B can be configured as a living hinge or a ball-and-socket hinge or other type of flexible cleaning head connector 112A-B. The cleaning heads 102A-C may be coupled to neck elements 106A-C, respectively. The cleaning heads 102A-C and cleaning head connectors 112A-B may be arranged adjacent to each other along a longitudinal composite cleaning head axis 124 (see FIG. 1) and cleaning head connectors 112A-B may be arranged along composite cleaning head axis 124. The longitudinal cleaning head axis 124 can be substantially perpendicular to the longitudinal apparatus axis 126 (see FIG. 1).

The cleaning heads 102A-C can be coupled to neck elements 106A-C, respectively, at a neck element first end 120A-C and a cleaning head proximal portion 122A-C, respectively. A connection between neck elements 106A-C and cleaning heads 102A-C can be operable to allow the cleaning heads 102A-C to sufficiently pivot in a variety of directions. A connection between neck elements 106A-C and cleaning heads 102A-C can allow the cleaning heads 102A-C to pivot about an axis sufficiently perpendicular to composite cleaning head axis 124.

Means can be provided to allow one or more of cleaning heads 102A-C to substantially pivot about an axis substantially perpendicular to composite cleaning head axis 124 (that is, an axis parallel to the longitudinal axis of the apparatus 126) while restricting the cleaning heads from pivoting about an axis substantially parallel to the longitudinal composite cleaning head axis 124. Such a configuration may offer increased latitude in selecting or specifying the cleaning tools 104. For example, in the case of a toothbrush having cleaning tools 104 that are bristles, the bristles may be shorter than usual in order to allow comparatively greater user control and/or to reduce the amount of splaying of bristles, which may be advantageous in cleaning the interdental spaces and may also prolong the useful life of the bristles.

A coupling of neck elements 106A-C and cleaning heads 102A-C may facilitate cleaning tools 104A-C contacting a wide range of surface contours, including concave, convex, planar and non-planar surfaces, while still allowing the cleaning tools to maintain sufficient contact with a surface being cleaned. The coupling between the neck elements 106A-C and the cleaning heads 102A-C may be flexible or resilient. The cleaning apparatus 200 may include the means for facilitating axial pivoting of at least one cleaning head 102.

Cleaning head pairs 102A and 102B, and 102B and 102C, may optionally be coupled by flexible cleaning head connectors 112A and 112B, respectively. Cleaning head connectors 112A and 112B may be a living hinge or another type of flexible connector. The coupling between cleaning heads 102A and 102B, and 102B and 102C, may allow cleaning tools 104A-C to contact a wide range of surface contours including concave, convex, planar, and non-planar surfaces while allowing the cleaning heads 102 to maintain their lateral relationship to one another. The cleaning apparatus 200 can include cleaning head connectors 112A and 112B and neck elements 106A-C. The neck elements 106 can be sufficiently flexible to allow the cleaning heads 102 to conform to contours of a surface to be cleaned while remaining operable to allow the cleaning tools to maintain sufficient contact with a surface being cleaned. In one or more embodiments, at least one individual neck element 106 is flexible and in one or more other embodiments, at least one cleaning head 102 is not connected to another cleaning head.

The cleaning heads 102A-C may each include a cleaning tool 104A-C, respectively, attached thereto. Cleaning tools 104A-C may include at least one of a sponge, wire, lambs' wool, steel wool, abrasive material, a pad, and/or bristles (e.g., natural or synthetic, hair, fibers, filaments, or any combination thereof that are of any stiffness, or combination of stiffnesses). The cleaning tools 104A-C may be disposed on a cleaning head bottom side (not labeled) that is opposite a cleaning head topside 110A-C (see FIG. 3). At least one cleaning tool 104 can be soft, have medium stiffness, or be stiff. Different cleaning tools, such as cleaning tools 104A and 104B or 104C, can have different stiffnesses. The cleaning tools 104 can include bristles and portions of the bristles can be of varying lengths. The bristles of one cleaning tool 106A may be of different length from those of one or more other cleaning tools 106B-C.

Figure 3:
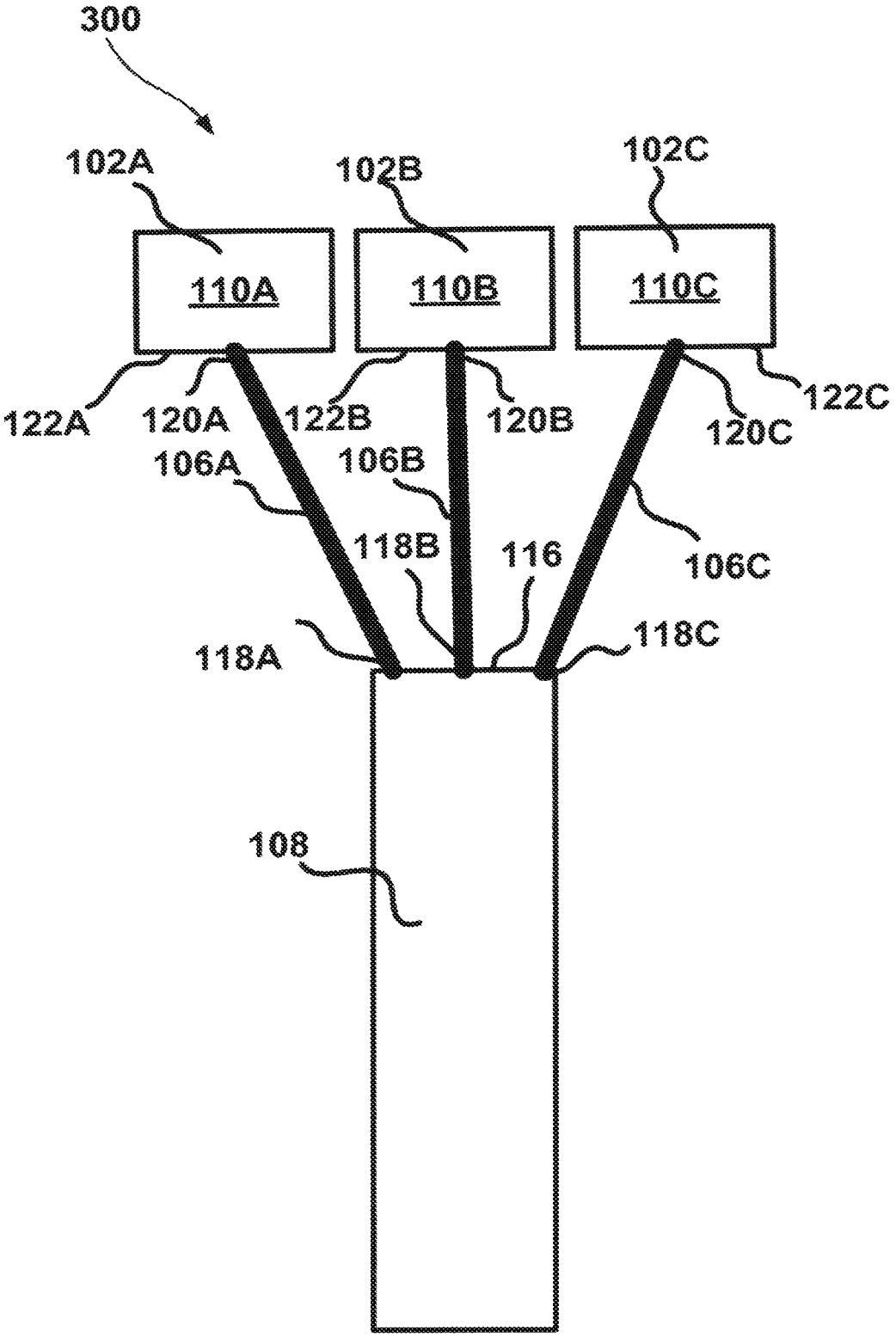
FIG. 3 is a top view diagram of an example of a transversal cleaning apparatus.
Figure 4:
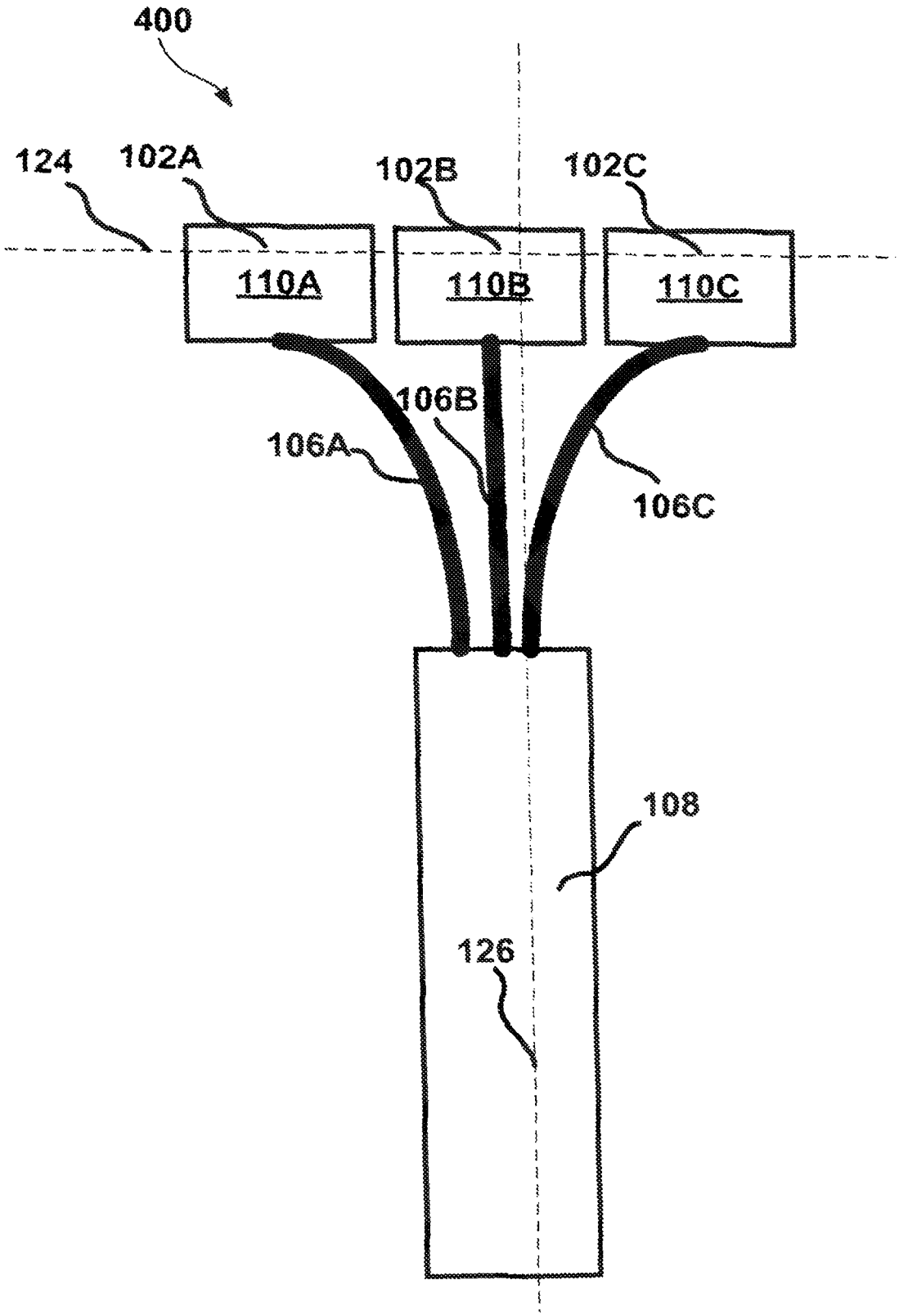
FIG. 4 is a top view diagram of an example of a transversal cleaning apparatus.
Figure 5:
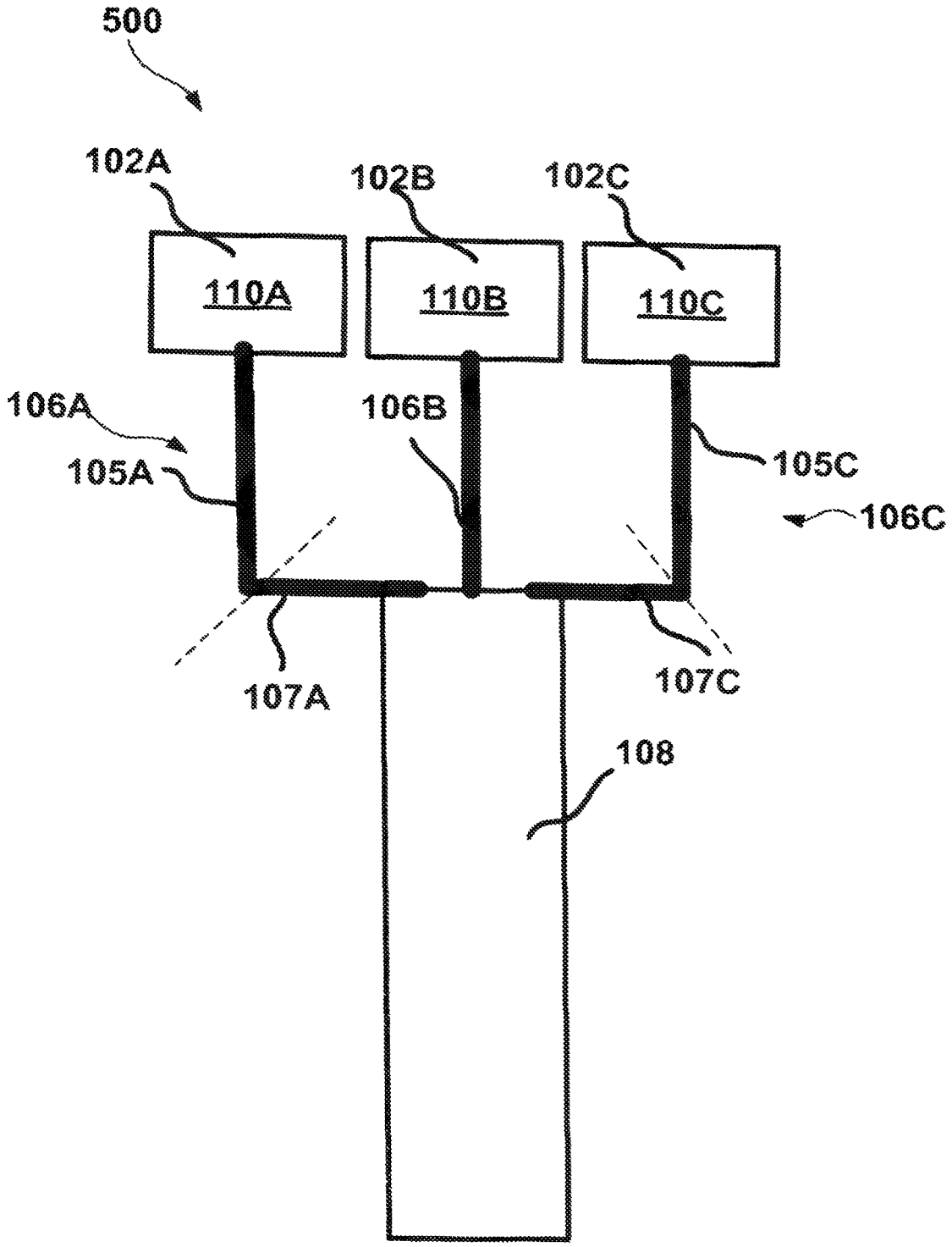
FIG. 5 is a top view diagram of an example of a transversal cleaning apparatus.

The neck elements 106A-C may be coupled to the handle 108. The neck elements 106A-C may be substantially straight (as shown in FIG. 1-3, among others) or substantially curved or angled (as shown in FIGS. 4 and 5). The figures demonstrate only a few possible axial curvatures for neck elements 106A-C, with the many other neck element curvatures possible including compound curves (e.g., convex-concave, concave-convex, concave-straight, convex-straight, etc.). Individual neck element curvatures may also be planar, wherein the curves depart from the longitudinal plane of the apparatus, from the longitudinal plane of the neck element itself, or from both. Individual neck element curvatures may be axial, planar, or a combination of axial and planar. Neck elements 106A-C may be connected to optional flexible handle connectors 114A-C, respectively, at a neck element second end 118A-C, respectively. The handle connectors 114A-C may be connected to handle 108 at a handle first end 116. The neck elements 106A-C may be elastomeric and may allow the cleaning tools 104A-C to contact a wide range of surface contours, including concave, convex, planar and non-planar surfaces, while still allowing cleaning tools 106 to maintain sufficient stability and contact with a surface being cleaned. The neck elements 106A-C may be substantially rigid and coupled to optional flexible handle connectors 114A-C to facilitate cleaning tools 104A-C contacting a wide range of surface contours, including concave, convex, planar and other non-planar surfaces, while keeping the cleaning heads 102A-C substantially stable to allow the cleaning of a surface being contacted. Other combinations of elastomeric or rigid handle connectors 114 and elastomeric or rigid neck elements 106 are possible.

Figure 6:
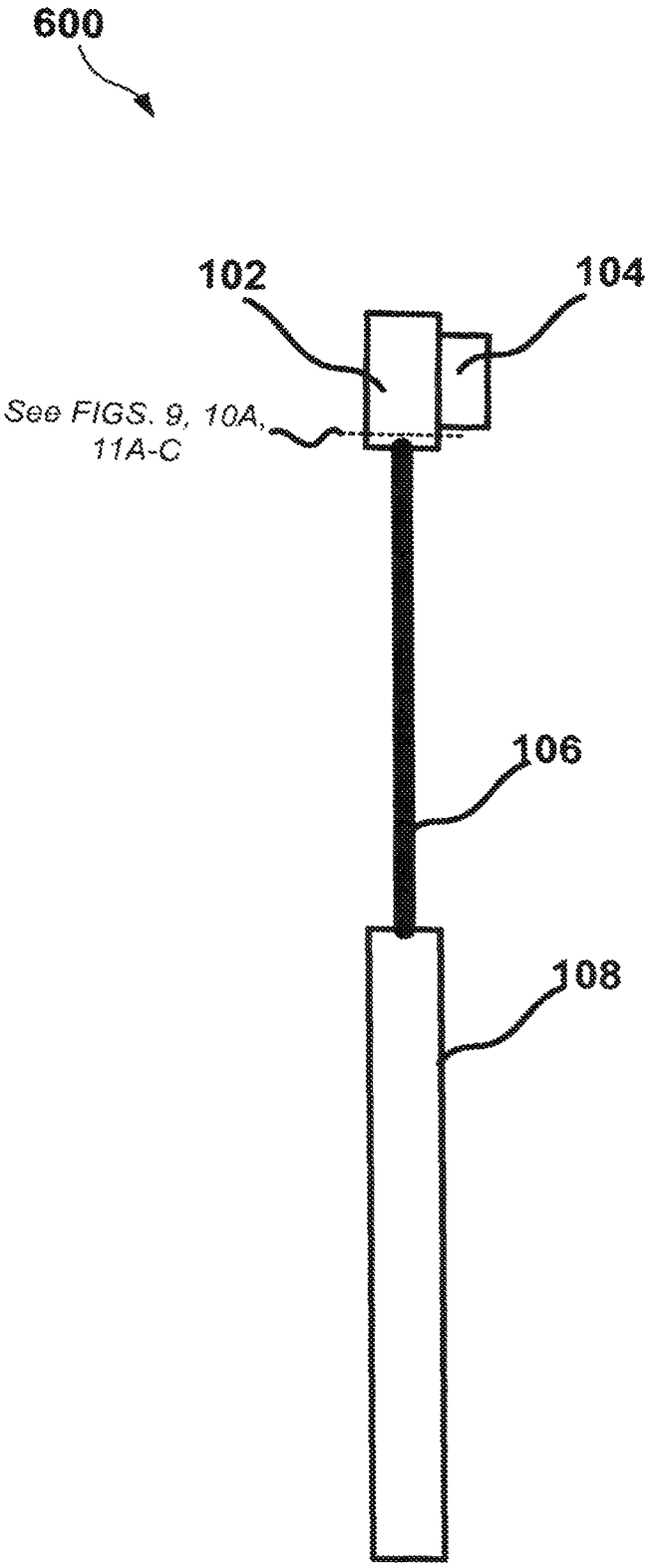
FIG. 6 is a side view diagram of an example of a transversal cleaning apparatus.
Figure 7:
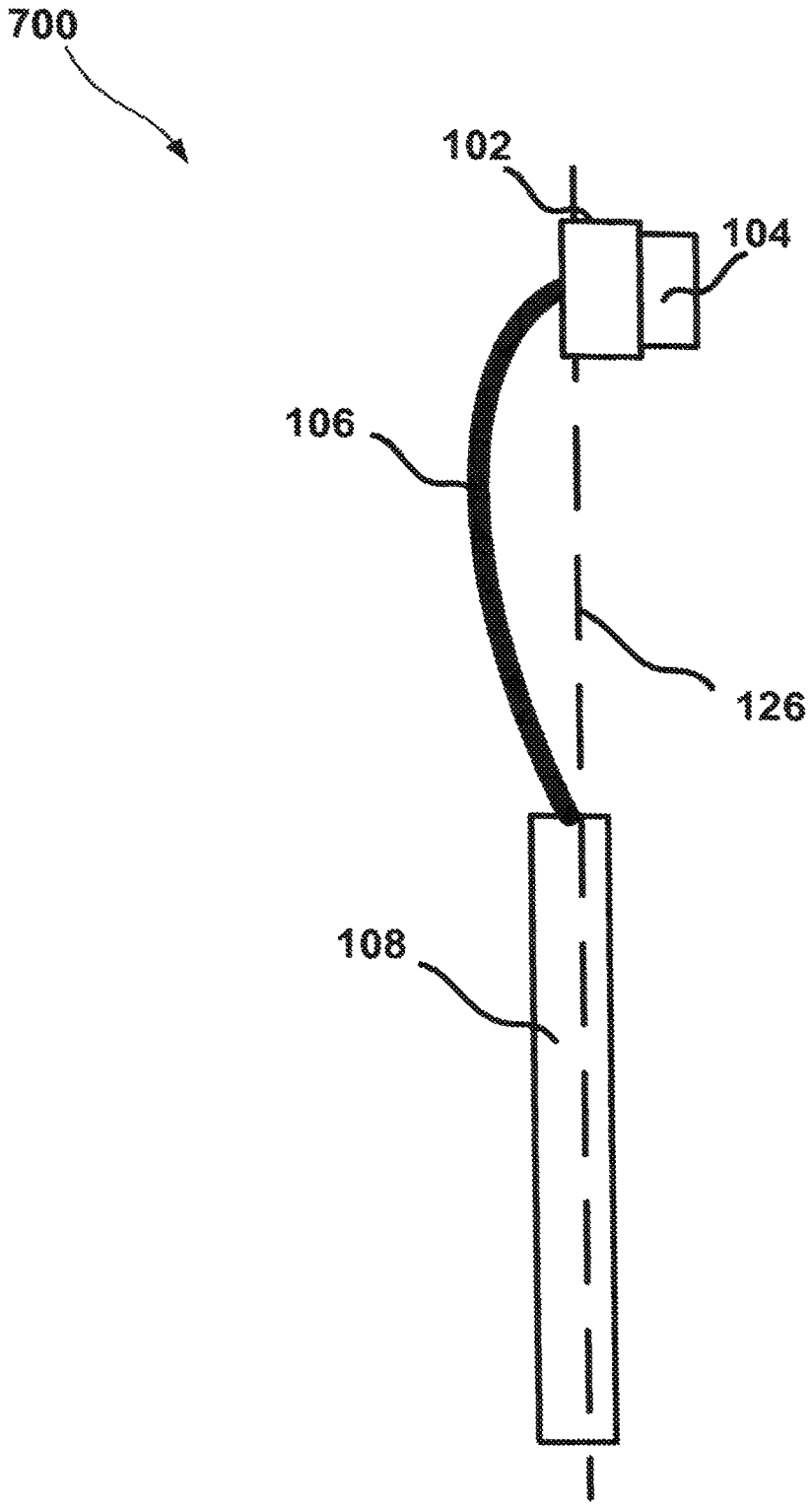
FIG. 7 is a side view diagram of an example of a transversal cleaning apparatus.
Figure 8:
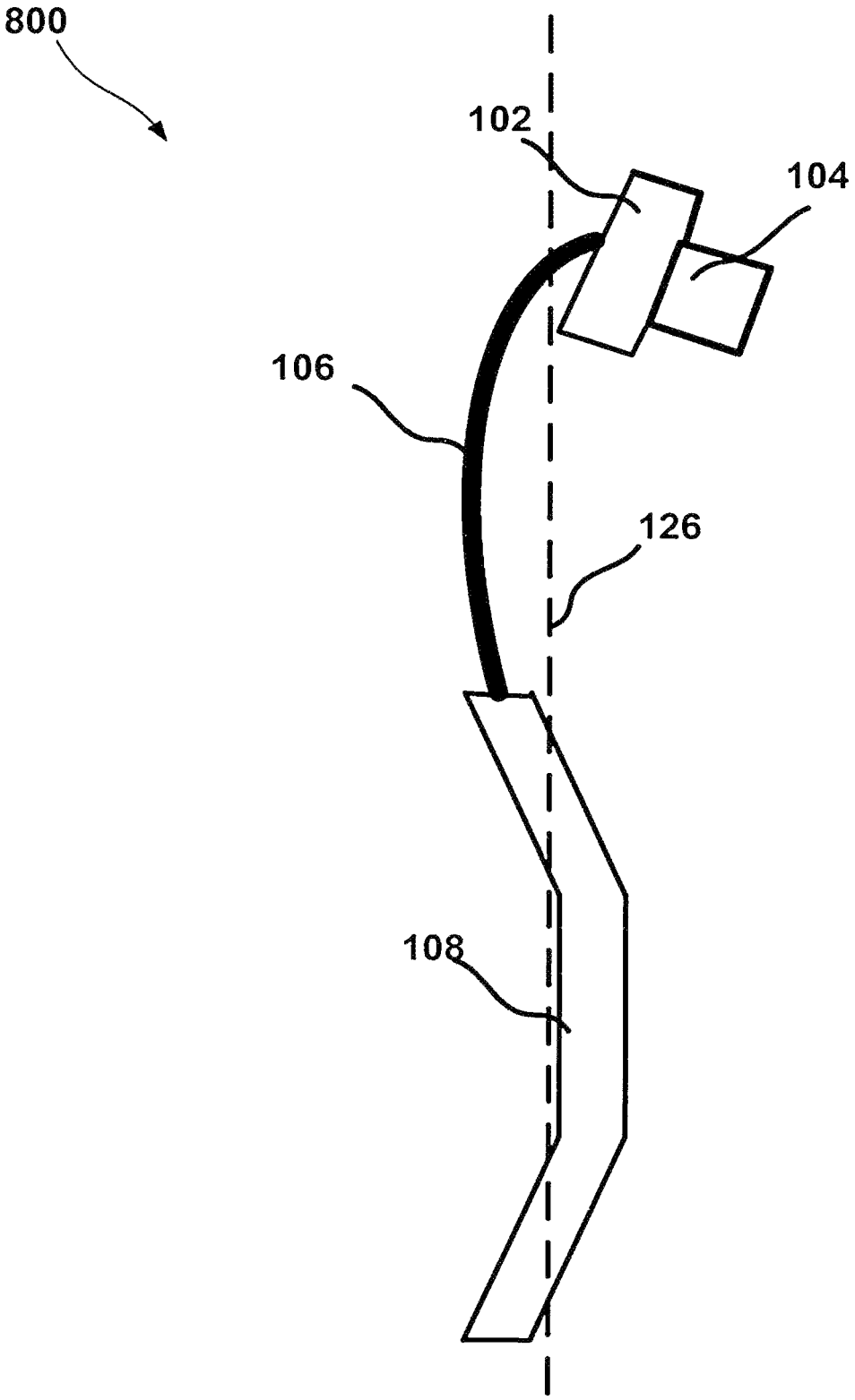
FIG. 8 is a side view diagram of an example of a transversal cleaning apparatus.

Handle 108 may be substantially elongate and straight (as shown in FIGS. 6 and 7) or curved (as shown in FIG. 8). The handle 108 can be curved so as to fit comfortably into a human hand. The handle 108 can be substantially curved so as to allow the cleaning apparatus 200 to reach locations that would normally be difficult or impossible to reach with a cleaning apparatus having a straight handle 108. A combination of curves on a neck element 106 and curves on a handle 108 can allow the cleaning tools 106 to reach locations that would otherwise be difficult or impossible to reach with a cleaning apparatus 200 having a straight handle 108. The handle 108 can be elongate and can include at least one bend. The handle 108 can be non-elongate. When the cleaning apparatus 200 is configured as a mop or a broom, the handle 108 may be straight and substantially longer than in the case of an embodiment as a toothbrush. When the cleaning apparatus 200 is configured as a human hygiene cleaning apparatus, such as a bath and shower brush, the handle 108 may have a length intermediate between that of a toothbrush and an apparatus for cleaning broad surfaces, such as a floor or a wall or an inner or an outer surface of a container, including but not limited to a tub or a sink. Such embodiments can be configured as a mop or a broom.

The cleaning head connectors 112A and 112B can be made of flexible (e.g., elastomeric) material sufficient to allow the orientation of cleaning heads 102A-C to be altered to responsively conform to the plane of a surface to be cleaned while still allowing cleaning tools 104A-C to maintain sufficient contact with the surface being cleaned. The neck elements 106A-C may be made of flexible material sufficient to produce the same effect. The handle connectors 114A-C may be made of flexible material sufficient to help produce the same effect. Combinations of a flexible cleaning head connector 112, a flexible neck element 106, or a flexible handle connector 114 may be used to allow the orientation of cleaning heads 102A-C to responsively and reversibly deform with respect to a surface to be cleaned while still allowing cleaning tools 104A-C to maintain sufficient contact with the surface being cleaned. The cleaning apparatus 200 may include a cleaning head 102 that includes means for allowing one or more cleaning heads 102 to pivot substantially independently about an axis substantially perpendicular to the longitudinal composite cleaning head axis 124 while still allowing cleaning tools 104 to maintain sufficient contact with a surface being cleaned. A cleaning head connector 112 or a handle connector 114 may be made of rubber, plastic, elastic, polymer, or any other material capable of coupling cleaning heads 102, or any combination thereof.

While FIG. 2 depicts cleaning apparatus 200 as including three cleaning heads 102A-C, three corresponding cleaning tools 104A-C, and three corresponding neck elements 106A-C, it should be appreciated that any number of cleaning heads 102, cleaning tools 104 and neck elements 106 greater than one may be included. While FIG. 2 depicts apparatus 200 as including two cleaning head connectors 112A and 112B any number of cleaning head connectors, zero or more, may be included. While FIG. 2 depicts cleaning apparatus 200 as including three handle connectors 114A-C, any number of handle connectors, zero or more, may be included. The cleaning apparatus 200 may include a combination of neck elements 106 having a "trident" configuration as shown in FIG. 5. In one or more embodiments, the cleaning apparatus 200 may include three neck elements 106A-C and three cleaning heads 102A-C, with the central neck element 106B shorter than the other two neck elements 106A and 106C. The width of cleaning heads 102A and 102C may be such that the medial portion of one or both is closer to the longitudinal axis of the apparatus than is the lateral most portion of cleaning head 102B. Such a configuration can facilitate cleaning head 102B sweeping debris pushed in a medial direction by cleaning heads 102A and 102C. In another embodiment, central neck element 106B is longer than neck elements 106A and 106C, and the width of cleaning head 102B is such that its lateral portions are farther from the longitudinal axis of the apparatus than are the medial portions of cleaning heads 102A and 102C. Such a configuration can allow the cleaning head 102A or 102C to sweep away debris pushed aside (e.g., laterally) by cleaning head 102B. FIG. 3 is a top view diagram of an example of a transversal cleaning apparatus 300. The cleaning apparatus 300 may include cleaning heads 102A-C coupled to neck elements 106A-C, respectively. The cleaning heads 102A-C can be coupled to neck elements 106A-C, at a cleaning head first side/portion 122A-C and neck element second end 120A-C, respectively. The cleaning heads 102A-C may include a cleaning head top side 110A-C opposite a cleaning bottom side (not shown in FIG. 3). The neck elements 106A-C may be coupled to the handle 108 at a handle first end 116 and neck element second ends 118A-C, respectively.

FIG. 4 is a top view diagram of an example of a cleaning apparatus 400. Cleaning apparatus 400 may be substantially similar to the cleaning apparatus 100, 200, 300, or 500 with cleaning apparatus 400 including two curved neck elements 106A and 106C, and a substantially straight neck element 106B. The curvature of the neck elements 106A and 106C can aid in allowing cleaning heads 102A-C to facilitate cleaning some surfaces that may be more difficult for a cleaning apparatus with straight neck elements to access. In the case of a cleaning apparatus configured as a toothbrush, the difficulty in access may be caused by the shape or size of a human or animal mouth. An embodiment having any number of individual neck elements 106 may include curved individual neck elements. The curve of any individual neck element 106 may be a compound curve comprising a first portion that is concave to the longitudinal axis 126 of the apparatus and a second portion convex to the longitudinal axis 126 of the apparatus.

FIG. 5 is a top view diagram of an example of a cleaning apparatus 500. Cleaning apparatus 500 may be substantially similar to cleaning apparatus 100, 200, 300, 400, 600, 700, and 800, with neck elements 106A and 106C that include sharp bends (e.g., angles or curves). Neck elements 106A and 106C may include a bend that permits the longitudinal axis of a first neck portion 107A and 107C to form an angle of between about 60 degrees and about 90 degrees with the longitudinal axis of the cleaning apparatus 126 (not shown). The longitudinal axis of the distal most portion of an adjacent second neck portion 105A and 105C can form an angle of between about 60 degrees and 90 degrees (e.g., can be perpendicular) with the longitudinal axis of the composite cleaning head 124. The length of second neck portion 105A or 105C and individual neck element 106B may be shorter than that shown in other embodiments. The second neck portion 105A or 105C may be substantially perpendicular to the first neck portion 107A or 107C and substantially parallel to a longitudinal apparatus axis 126 (see FIG. 1). A neck element 106A or 106C can include a bend of 90 degrees or more.

FIG. 6 is a side view diagram of an example of a transversal cleaning apparatus 600. The cleaning apparatus 600 may be substantially similar to the transversal apparatus depicted in FIG. 1, 2, or 3. Transversal cleaning apparatus 600 may include cleaning heads 102 (102A-C) including cleaning tools 104 (104A-C) attached thereto. Cleaning head 102 may be coupled to neck elements 106. Neck element 106 may be substantially straight. Neck element 106 may be coupled to handle 108. Handle 108 may be substantially straight, as shown, or substantially curved so as to fit comfortably into a human hand (as shown in FIG. 8, for example); or non-elongate. In one or more embodiments as a toothbrush, a curve on the handle 108 may combine with one or more curves on one or more individual neck elements 106 to help avoid contact between the handle or one or more neck elements and the chin of a user while in use. The handle 108 or a neck element 106, or both, may have axial and/or planar curves that help a user to accomplish other types of cleaning tasks in addition to cleaning the oral cavity.

FIG. 7 is a side view diagram of an example of a transversal cleaning apparatus 700. The cleaning apparatus 700 may be substantially similar to any other cleaning apparatuses discussed herein. The transversal cleaning apparatus 700 may include cleaning head 102 with a cleaning tool 104 attached thereto. Cleaning head 102 may be coupled to neck element 106. Neck element 106 may be substantially curved relative to the longitudinal axis of the apparatus 700. This may facilitate a cleaning tool 104 to substantially (e.g., effectively) contact a surface to be cleaned. Other type of curves may be included. For example, a neck element 106 may include a curve convex to the longitudinal apparatus axis or a convex-concave compound curve or a concave-convex compound curve. Neck element 106 may be coupled to handle 108. Handle 108 may be substantially straight, as shown, and of any desired length; or substantially curved so as to fit comfortably into a human hand (as shown in FIG. 8, for example).

FIG. 8 is a side view diagram of an example of a transversal cleaning apparatus 800. The cleaning apparatus 800 may be substantially similar to any of the other cleaning apparatuses discussed herein. The cleaning apparatus 800 may include a cleaning head 102 with a cleaning tool 104 attached thereto. The cleaning head 102 may be coupled to a neck element 106. The neck element 106 may be substantially curved to facilitate cleaning tools contacting a surface to be cleaned. The neck element 106 may be coupled to handle 108. The handle 108 may be substantially curved so as to fit comfortably into a human hand, as shown, or substantially straight, and alternatively may have any other desired shapes. The angle of the gripping portion of the handle 108 may be configured to assist the user in grasping the handle 108 with minimal ulnar or radial deviation of the wrist. In addition, the gripping portion of the handle 108 can be configured to reduce the degree of ulnar-radial and radial-ulnar rotation of the hand, wrist, and forearm in cleaning the oral cavity or recess. The cleaning head 102 may be coupled to a neck element 106 with an orientation that is canted, as shown in FIG. 8, for example. The cleaning head 102 can be canted in relation to a longitudinal axis of the apparatus 126 or in relation to the longitudinal plane of the neck element 106. A cleaning head 102 with an orientation that is non-coplanar with the longitudinal plane of the apparatus, for example, may allow a user to reach surfaces that would be more difficult to reach if the cleaning head 102, and corresponding cleaning tool 104, were not canted.

While the transversal cleaning apparatuses depicted in FIGS. 1 and 3-8 are shown as not including a cleaning head connector 112 (see FIG. 2), or handle connector 114 (see FIG. 2), these cleaning apparatuses may include a cleaning head connector 112 and/or a handle connector 114.

Figure 9:
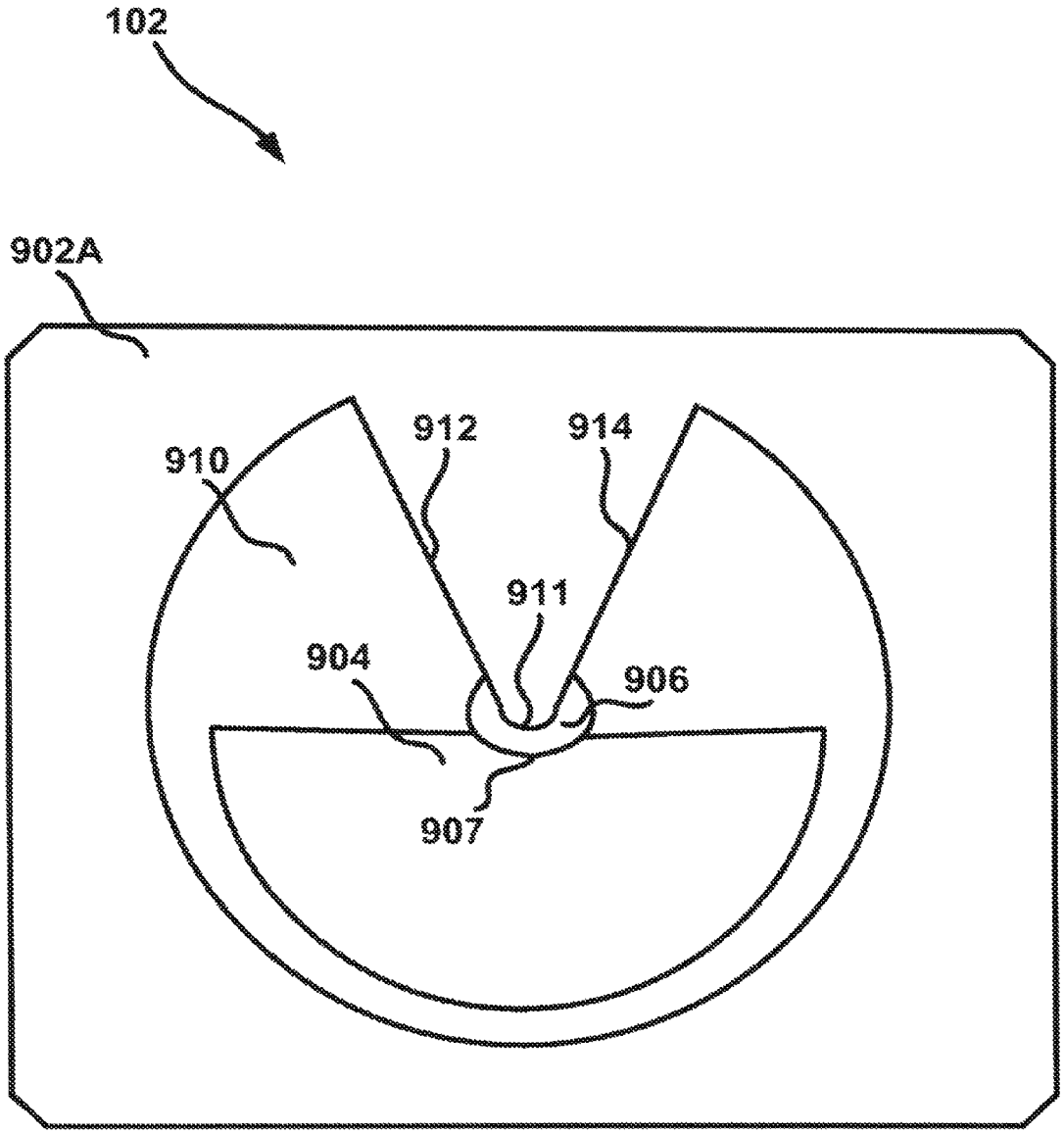
FIG. 9 is a cross-sectional view diagram of an example of an individual cleaning head that includes an "M" channel.

FIG. 9 is a cross-sectional view diagram of an example of a cleaning head proximal portion of a cleaning head 102. The cleaning head 102 may comprise a body 902A and a channel 910. The cleaning head body 902A can be a one-piece or unitary structure, or can comprise two structural constituents. The structural constituents can be disposed on opposing sides of a horizontal cleaning head body plane that may be located at a heightwise cleaning head body midpoint, or another location, and fixedly joined. In one or more embodiments, the cleaning head body 102 is formed by fixedly joining a left-hand and a right-hand constituent portion. The two structural constituents can be disposed on opposing sides of a vertical cleaning head body plane that may be located at a widthwise cleaning head body midpoint, or at another location. In either embodiment, the cleaning head 102 can include an upper cleaning head portion 1002B and a lower cleaning head portion 1002A (see FIG. 10). The lower cleaning head portion 1002A of a cleaning head body 902 is defined herein as the portion of the cleaning head body on a side of a widthwise cleaning head plane that is closer to the cleaning tools and the upper cleaning head portion 1002B is defined as the portion of the cleaning head body on an opposing side of the widthwise cleaning head plane. This definition is independent of the structural configuration of the cleaning head body 102, such that, for example, each cleaning head body 102 includes upper and lower portions and may comprise either left-hand and right-hand structural constituents or upper and lower structural constituents. For clarification, the upper and lower portions of the cleaning head are defined by which side of the widthwise plane they are located on, while the structural constituents of the cleaning head are left or right, or upper and lower.

The channel 910 can be substantially circular. A cross-section of the channel 910 can be substantially round (e.g., nearly a full circle except for a generally triangular pie-shaped sector that is part of the cleaning head body 902A and defined, at least in part, by an opening first side 912 and an opening second side 914). The channel 910 may traverse a length of the body 902A from an aperture at the proximal portion thereof to a location adjacent the distal portion of the cleaning head 102. The channel 910 may traverse the entirety of the cleaning head 102, from an aperture at the proximal portion thereof to an aperture at the distal portion of the cleaning head 102. A shaft 904 disposed within the channel 910 may include two flanges 1032A-B (see FIG. 10) external to and adjacent the cleaning head 102. Shaft 904 may be a structurally discrete element affixed to a first neck end 106. Shaft 904 may be integral with a first neck end 106 and constitute the distal portion of a neck 106. A flange 1032B can be adjacent the proximal portion of the cleaning head 102 and another flange 1032A can be adjacent to the distal portion of the cleaning head 102. The flanges 1032A-B can be spaced such that the cleaning head 102 is substantially restricted from moving in a direction coaxial with the shaft 904. The flanges 1032A-B can be spaced such that the cleaning head 102 can pivot about an axis substantially perpendicular to the composite cleaning head longitudinal axis 124. The diameter of the shaft 904 is sufficiently smaller than the diameter of the cross-section of the channel to permit the cleaning head 102 to pivot.

Figure 10A:
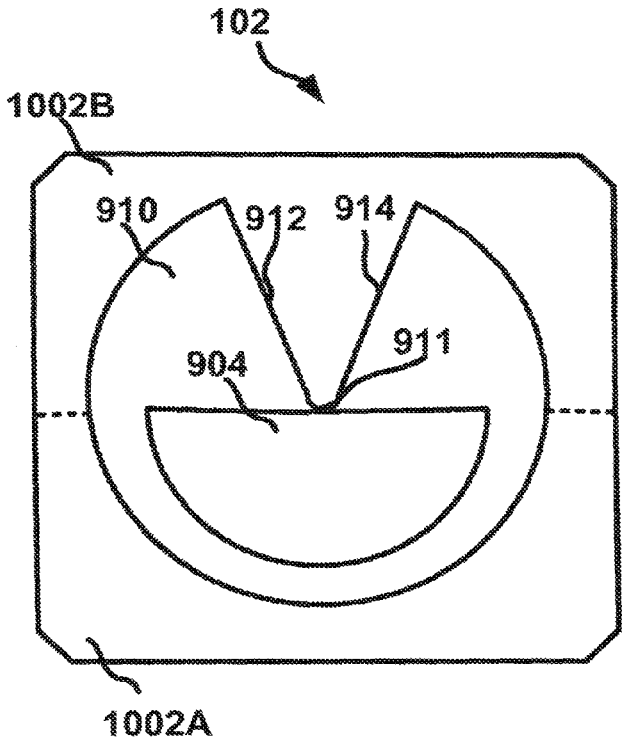
FIG. 10A is a cross-sectional view diagram of an example of an individual cleaning head that includes an "M" channel.

The shaft 904 can have a substantially semi-circular cross-section wherein the flat side of the shaft 904 faces the upper portion of the cleaning head 1002B (see FIG. 10A). A pivoting piece 906 can be coupled to the vertex 911 formed by the intersection of opening first side 912 and opening second side 914 of cleaning body 902. The pivoting piece 906 may be made of elastomeric material sufficiently flexible to allow the shaft 904 to pivot in the opening 910. A socket or depression 907 may be included in the shaft 904 to cooperate with pivoting piece 906. Such a feature can help provide stability to the connection. The shaft 904 and related components can be disposed at a location other than a longitudinal midpoint of the cleaning head 102, such as, for example, a location in between the longitudinal midpoint and a medial portion of the cleaning head 102. The coupling between the pivoting piece 906 and the shaft 904, including a coupling between the pivoting piece 906 and the socket 907, can allow the cleaning head 102 to pivot from a position where opening first side 912 contacts the flat side of the shaft 904 to a position where opening second side 914 contacts the flat side of the shaft 904, wherein the cleaning head 102 may be operable to make sufficient contact with a surface to be cleaned at any position therebetween.

The cleaning head body 902 can be made of plastic, ceramic, metal, wood, polymer, or any combination thereof. In one or more embodiments, the cleaning head body 902 is made of the same material as the individual neck element 106.

The shaft 904 may be a structurally discrete element extending distally of the second end 120 of the neck element 106. The shaft 904 can be an extension of the neck element 106 (that is, the shaft 904 can be the distal portion of neck element 106).

Figure 10B:
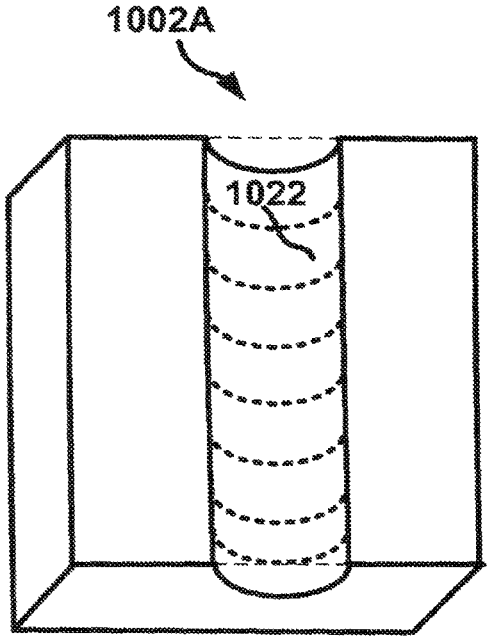
FIG. 10B is a perspective diagram of an example of a lower cleaning head component of an individual cleaning head.
Figure 10C:
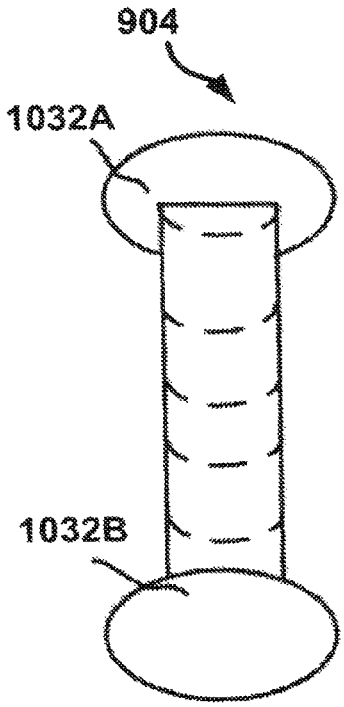
FIG. 10C is a perspective diagram of an example of a shaft.
Figure 10D:
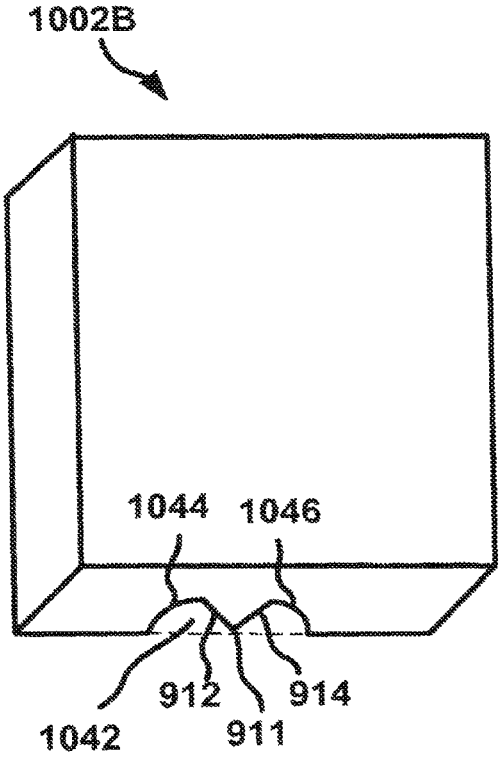
FIG. 10D is a perspective diagram of an example of an upper cleaning head component of an individual cleaning head.

FIG. 10A is a cross-sectional diagram of an example of a cleaning head 102. The cleaning head 102 may include an upper cleaning head portion 1002B, lower cleaning head portion 1002A, a channel 1010, and a shaft 904, such as is shown in FIGS. 10B, and 10D, and 10C, respectively. The cleaning head 102 can include an upper and a lower cleaning head constituent, wherein the two constituents are fixedly joined to create the cleaning head body 102. In other embodiments, the cleaning head body 102 can include a left-hand and a right-hand cleaning head constituent, wherein the two constituents are fixedly joined to create the cleaning head body.

FIG. 10B is a perspective view diagram of an example of a lower cleaning head portion 1002A. The lower cleaning head portion 1002A may include a channel 1022 that traverses the cleaning head 102 from the proximal portion of the cleaning head 102 to the distal portion of the cleaning head 102. In one or more embodiments, the channel 1022 does not penetrate the distal portion of the lower cleaning head portion 1002A. The channel 1022 can be configured to accept a half-round shaft.

FIG. 10C is a perspective view of an example of a shaft 904 in which the cross section of the shaft 904 may be substantially semi-circular, wherein the flat side faces the upper portion of the cleaning head 102. The cross-section of the shaft 904 may be substantially circular or other shape. The shaft 904 may include either or both of flanges 1032A and 1032B, which are depicted as disposed on opposite ends of shaft 904. There may be a single flange 1032 disposed at a location other than at an end of the shaft 904. In some embodiments, all flanges 1032 can be disposed within the cleaning head 102, that is, in between the proximal and distal portions of the cleaning head body. In other embodiments, one flange 1032 can be disposed externally to the cleaning head 102 and adjacent to either the proximal portion or the distal portion of the cleaning head 102, with a second flange disposed within the cleaning head 102. In yet other embodiments, one flange is located within the cleaning head 102 and two other flanges are located external to the cleaning head and disposed adjacent thereto, wherein one flange is adjacent the proximal side of the cleaning head and a second flange is adjacent the distal side of the cleaning head. The shaft 904 can be made of rigid or flexible material. The shaft 904 is immobile. FIG. 10B depicts the portion of the channel 1022 that is disposed within the lower portion of the cleaning head body and FIG. 10D depicts the portion of the channel 1042 that is disposed within the upper portion of the cleaning head body. The cross-section of channel portion 1022 is configured to articulate with the half-round cross-section of the shaft 904, wherein responsive pivoting of the cleaning head 102 may bring portion 912 or portion 914 of the upper portion of the channel 1042 into contact with the flat surface of the shaft 904 in accordance with force applied to the cleaning tools of the cleaning head, which prevents further pivoting of the cleaning head 102.

When located externally to the cleaning head, flanges 1032A and 1032B may be substantially circular or other shape, such as rectangular, triangular, other polygonal shape, elliptical, or some irregular shape. When located within the cleaning head, flanges 1032 can be substantially round and can be restrained within a circumferential channel within cleaning head body 1002 (not shown). Such a configuration can restrain cleaning head 102 from moving in a direction coaxial with the longitudinal axis of the shaft 904. The number of flanges disposed within the cleaning head may be a number greater than zero. In other embodiments, there is a single flange 1032 that is disposed within cleaning head body 1002 (not shown) and restrained within a circumferential channel within cleaning head body 1002 (not shown). Any flange 1032 may be either integrally formed with the shaft 904 or may be a separate structure that is affixed to the shaft 904.

FIG. 10D is a perspective view of an example of an upper cleaning head portion 1002B. The upper cleaning head portion 1002B may include a channel portion 1042. The channel portions 1022 (see FIG. 10B) and 1042 may combine to form the channel 910. The channel portion 1042 can traverse the length of the upper cleaning head portion 1002B from the proximal portion of the cleaning head 102 to a location adjacent to the distal portion of the cleaning head 102. In one or more embodiments, the channel portion 1042 does not penetrate the distal portion of the upper cleaning head portion 1002B. The channel portion 1042 may be substantially shaped like an upper case letter "M." The upper case "M" may be defined by two arches 1044 and 1046, two sides 912 and 914, and a vertex 911. In some embodiments, the two lateral stem lines (that is, the two arches 1044 and 1046) of the capital letter "M" both have a concave curve facing the vertex 911 (e.g., the terminus of the middle stem of the capital letter "M"). In the example illustrated in FIG. 10A, the terminus of the middle stem of the capital letter "M" is disposed immediately adjacent to a line contiguous with a plane (indicated by the dashed line and extending the length of the channel) of a lower surface of the upper cleaning head portion 1002B, wherein said plane is contiguous with the flat surface of the shaft 904 when the cleaning head is in neutral or unstressed position. In one or more embodiments the channel portion 1042 has a substantially semi-circular cross-section and can cooperate with the channel portion 1022 to form a substantially round channel when the channel portions 1042 and 1022 face each other.

Figure 11A:
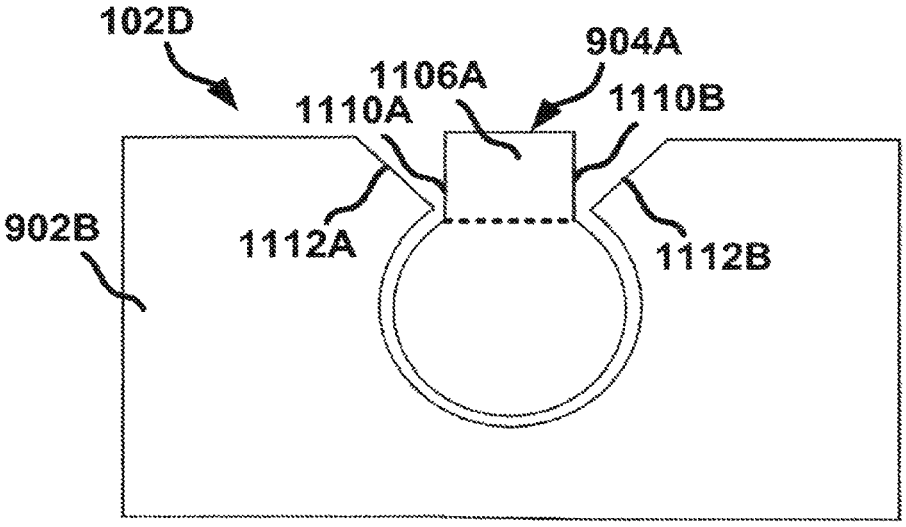
FIG. 11A is a cross-sectional diagram of an example of an individual cleaning head and a shaft or individual neck end.
Figure 11B:
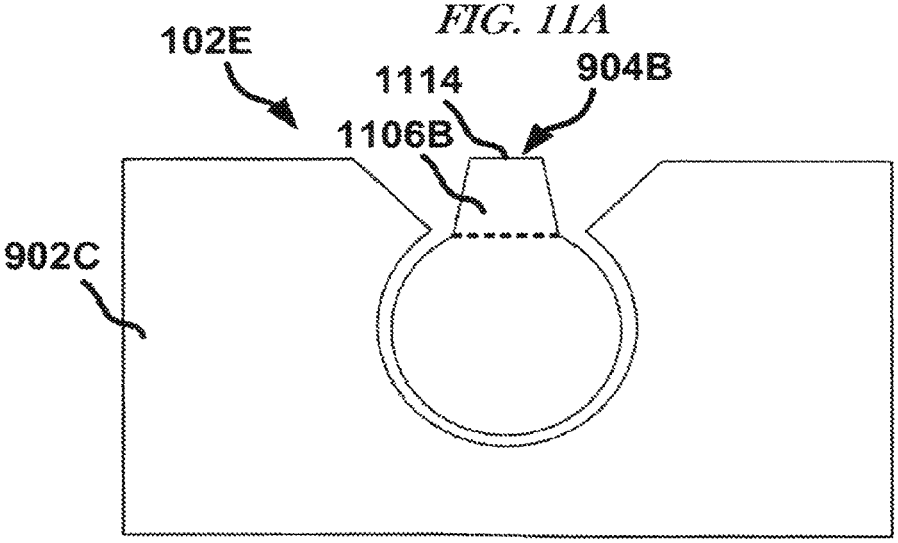
FIG. 11B is a cross-sectional diagram of an example of an individual cleaning head and a shaft or individual neck end.
Figure 11C:
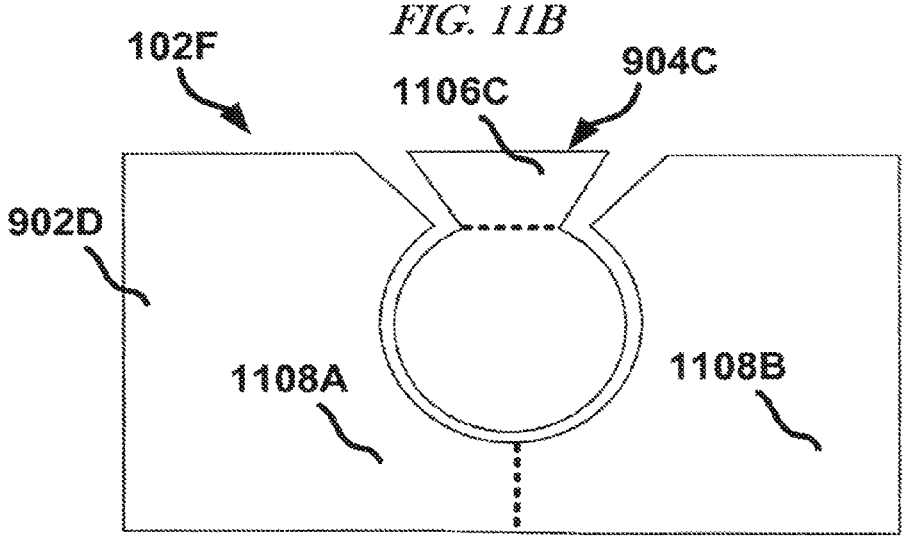
FIG. 11C is a cross-sectional diagram of an example of an individual cleaning head and a shaft or individual neck end.

FIGS. 11A, 11B, and 11C are cross-sectional diagrams of examples of cleaning heads 102D, 102E, and 102F, respectively. The cleaning heads 102D-F may comprise a cleaning head body 902B-D, respectively. The cleaning heads 102D-F may include an aperture at a surface of the cleaning head body 902B-D, with a cooperating cavity connected thereto. The cleaning head 102D-F can include a shaft 904A-C extending, at least partially, therethrough. The shaft 904A-C may comprise a protrusion 1106A-C.

The protrusion 1106A-C may be a polyhedron having a rectangular, square, triangular, trapezoidal, inverse trapezoidal, circular, or other shape. The protrusion 1106A-C may be operable to impose limits on the degree of bi-directional pivoting of the cleaning head body 902B-D about the shaft 904A-C, respectively. The degree of rotation permitted in the pivot can be a function of the degree of the angle formed by the intersection of the planes of the sides of the protrusion 1110A-B and the planes of the sides of the aperture 1112A-B. In the embodiments shown, the sides of the protrusion and the aperture 1110A-B and 1112A-B are substantially flat. In other embodiments, the sides of the protrusion 1110A-B may be concave and the sides of the aperture 1112A-B may be convex, or vice versa.

The top surface 1114 of the protrusion 1106 may be rounded and either concave or convex relative to the plane of the top side 110 of the cleaning head 102. The bottom face of a protrusion 1106 is indicated by a generally horizontal dashed line that is included to help illustrate that the protrusion 1106 can represent a part of a polyhedron. The protrusion 1106 may be formed separately and then affixed to the shaft 904, or may be formed as an integral part of the shaft 904. The cleaning head body 902B-D may be created by bonding, adhering, or otherwise joining an upper constituent and a lower constituent with a shaft 904 situated between the two constituents of the cleaning head body and within the channel. Alternatively, the cleaning head body 902B-D may be created by bonding, adhering, or otherwise joining a left-hand constituent 1108A and a right-hand constituent 1108B with a shaft 904 situated therebetween. FIG. 11C depicts cleaning head body constituents 1108A and 1108B (a boundary of the constituents is indicated by a vertical dashed line in FIG. 11C) of the cleaning head body 902D with the shaft 1104C situated therebetween. As used herein, limited rotation means rotation of less than 360 degrees. In some embodiments, rotation of the cleaning head body about the shaft may be limited to 180 degrees or less. The ends of a protrusion 1106 may be canted toward each other just enough to avoid contacting sides of an aperture 1204 and a cooperating cavity (see FIG. 12).

Figure 12:
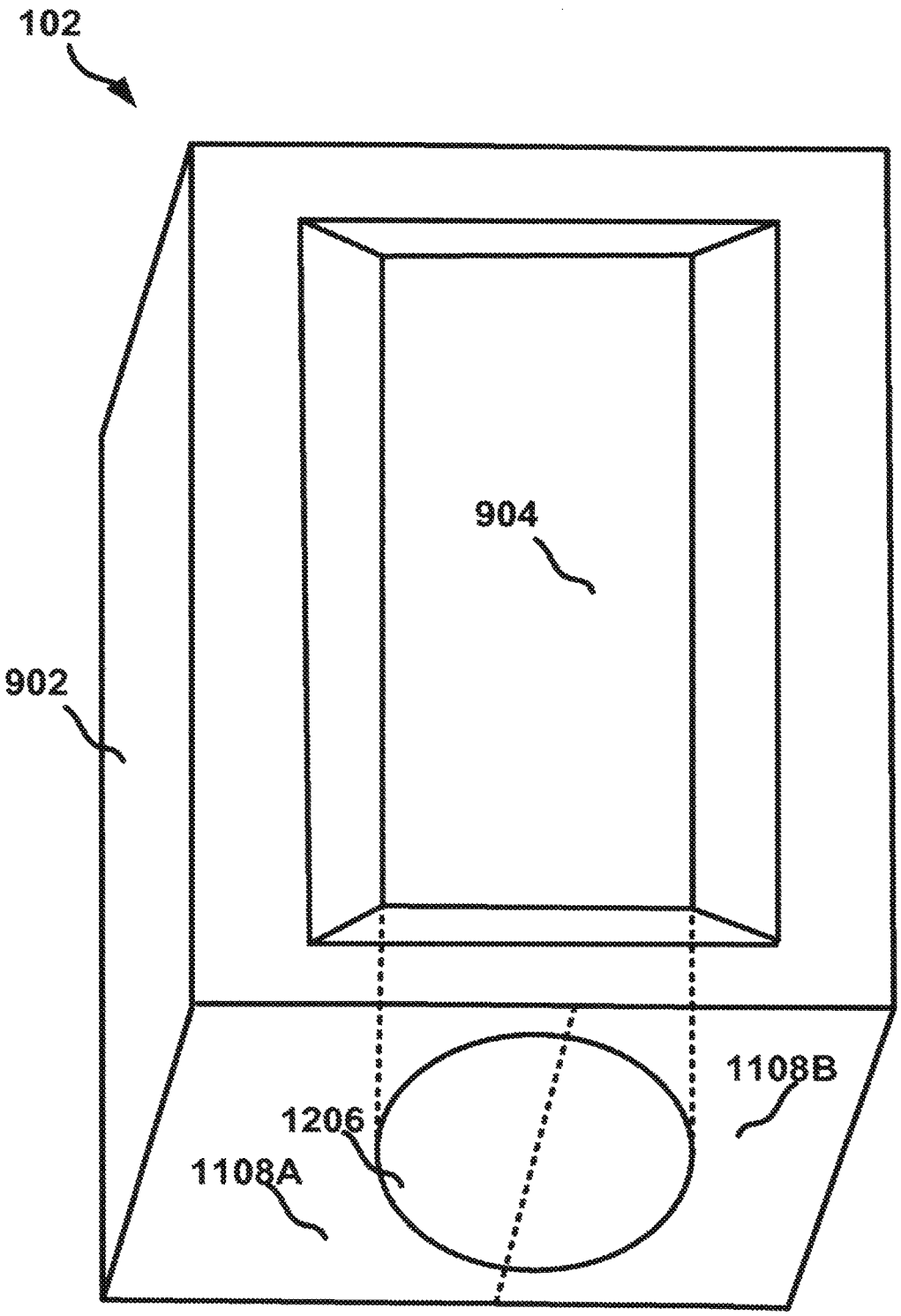
FIG. 12 is a perspective diagram of an example of an individual cleaning head.

FIG. 12 is a perspective diagram of an example of a cleaning head 102. The cleaning head 102 depicted in FIG. 12 may be substantially similar to cleaning head 102D-F. The cleaning head 102 may include an aperture 1204 in the upper portion of the cleaning head body 902 and a cooperating cavity. The cleaning head body 902 can include an opening 1206 configured to permit the shaft 904 to extend therethrough. While opening 1206 is depicted as being circular, the opening 1206 may be any shape configured to permit the shaft 904 to pass therethrough. In an embodiment where the shaft does not penetrate through the distal portion, an optional internal recess can be included in a cleaning head 102 distal portion (e.g., at the proximal surface of the distal portion), such as to add stability for the shaft. In one or more embodiments, the shaft can include two flanges, one configured to be situated on the distal side of the cleaning head 102 and the other configured to be situated on the proximal side of the cleaning head 102. One or more flanges can be internal to the cleaning head 102 or external to the cleaning head 102.

Figure 13:
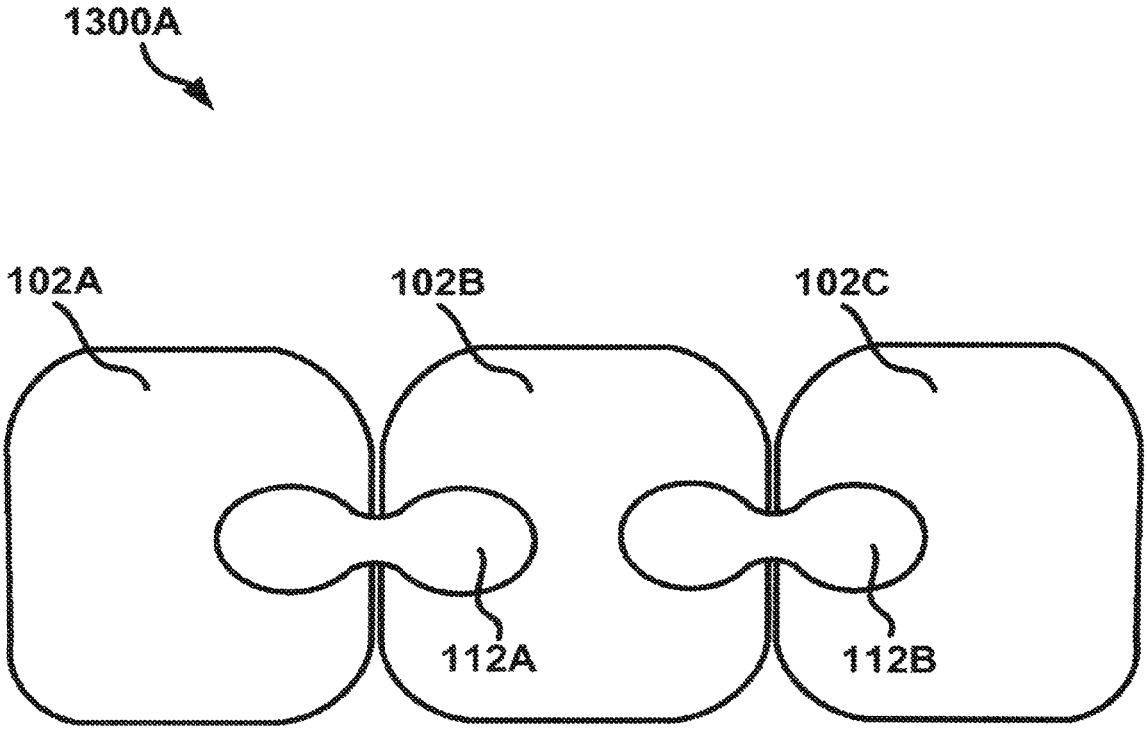
FIG. 13 is an end view diagram of an example of a composite cleaning head.

FIG. 13 is a cross-sectional diagram of an example of a composite cleaning head 1300A. The composite cleaning head 1300A may comprise cleaning heads 102A-C or any other cleaning head discussed herein. The composite cleaning head 1300A may comprise cleaning head connectors 112A and 112B. Cleaning head connectors 112A and 112B may be coupled between cleaning heads 102A and 102B, and 102B and 102C, respectively.

The cleaning heads 102A-C may include curved, rounded, or beveled corners. Such corners may allow a cleaning head 102A to pivot without interfering with the disposition or the pivoting of an adjacent cleaning head 102B. The cleaning heads 102 may be substantially square-shaped. They may also be rectangular, wherein their width exceeds their height, or vice versa. They may alternatively be ovaloid or elliptical. The cleaning heads 102 may include a lengthwise arch-shaped recession that extends the length of a lateral side of the cleaning head 102A and is adjacent to a complementarily-shaped protrusion on an adjacent cleaning head 102B. For example, cleaning head 102A is adjacent to 102B and includes an arch or recession cut out of the side that is adjacent to cleaning head 102B, which includes a complementarily-shaped protrusion.

Cleaning head connectors 112A and 112B may be formed from an elastomeric material to allow the cleaning head 102 coupled thereto to pivot. The elastomeric material may keep the cleaning heads adjacent and coupled to each other. The pivoting allowed by cleaning head connectors 112 can substantially restrict the cleaning heads 102 to pivoting about an axis substantially perpendicular to a composite cleaning head axis 124 (see FIG. 1). The pivoting allowed by cleaning head connectors 112 can be sufficient to facilitate a composite cleaning head 1300A to substantially reversibly deform responsively along a longitudinal plane when placed in contact with a curved, irregular, non-flat, or other contoured surface and pressure is applied, directly or indirectly, to the composite cleaning head 1300A and in the direction of a surface to be cleaned.

Figure 14A:
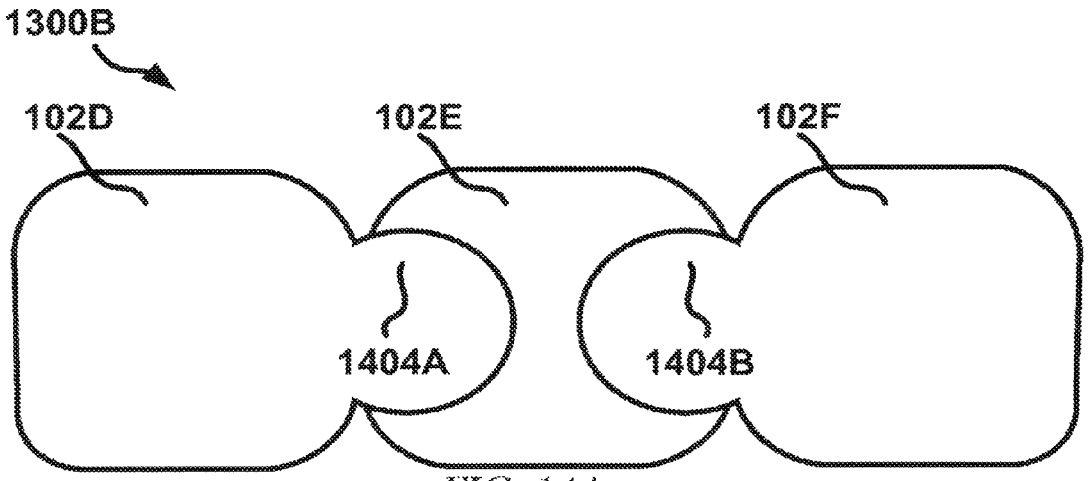
FIG. 14A is an end view diagram of an example of a composite cleaning head.

FIG. 14A is cross-sectional diagram of an example of a composite cleaning head 1300B. The composite cleaning head 1300B may include cleaning heads 102D-F. The cleaning heads 102D and 102F may each include a lengthwise protrusion 1404A-B having a ball-like cross-section, respectively, wherein the arc of the protrusions, which extend in a medial direction, substantially exceeds 180 degrees. Cleaning head 102E may include two lengthwise recessions (depicted as arches cut out of each lateral side of cleaning head 102E). The recessions can be substantially parallel to, and configured to accept, lengthwise protrusions 1404A and 1404C (as shown in FIG. 14A, for example). The protrusions 1404A and 1404C can traverse the lateral sides of the cleaning heads 102D and 102F, wherein the circumference of the protrusion 1404 exceeds 180 degrees and the profile of the cooperating recessions can substantially complement the arc of the protrusion 1404. The combination of a protrusion 1404 and lengthwise recession may function as a ball-and-socket hinge. In one or more embodiments, the arc of the rounded protrusions 1404 is 180 degrees or less. In one or more embodiments, protrusions 1404A and 1404C do not extend the length of the cleaning head. In one or more other embodiments, the lengthwise recessions of cleaning head 102E and the cooperating protrustions do not extend the length of the cleaning head.

Figure 14B:
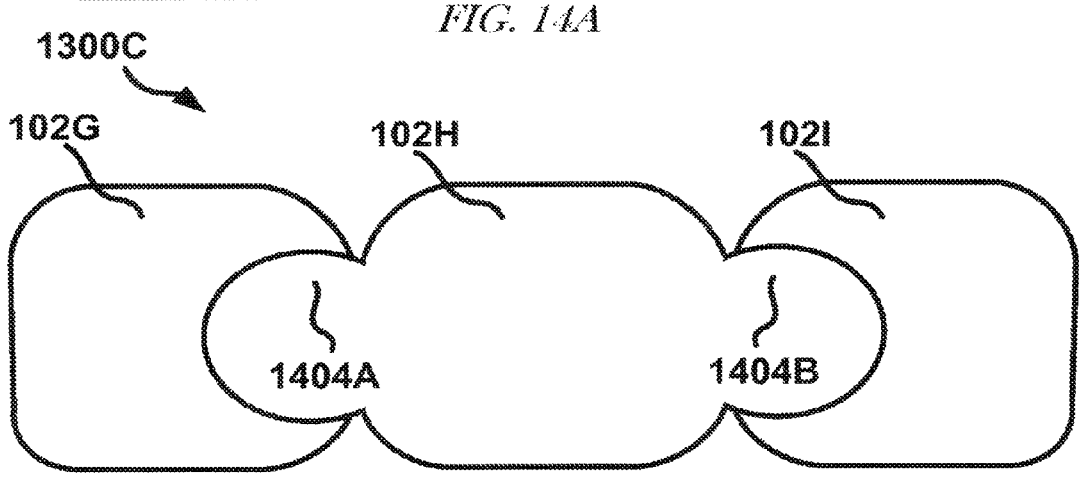
FIG. 14B is an end view diagram of an example of a composite cleaning head.

FIG. 14B depicts an example of a composite cleaning head 1300C. The composite cleaning head 1300C may include a cleaning head 102H that includes two ball-shaped lengthwise protrusions 1404A-B traversing opposite lateral sides of the cleaning head 102H and extending in lateral direction from cleaning head 102H, wherein the arc of the protrusions, which extend in a medial direction, substantially exceed 180 degrees. Cleaning heads 102G and 1021 may each include a lengthwise recession configured to substantially complement the lengthwise ball-shaped-profile protrusions 1404A and 1404B. A lengthwise hinge arrangement having a ball-and-socket profile, such as the one included in composite cleaning head 1300C, can create a flexible coupling that assists the composite cleaning head 1300C to reversibly deform to accommodate surfaces to be cleaned. The lengthwise rounded protrusion 1404 can have any degree of flexibility or resilience, or can be substantially rigid and inflexible. "Lengthwise" denotes extending substantially from the proximal portion of the cleaning head 102 substantially to the distal portion thereof.

A ball-and-socket hinge configuration of a composite cleaning head 1300 described herein can allow the composite cleaning head 1300 to reversibly and responsively deform to accommodate to curved, linear, or irregular surfaces (e.g., surfaces having depressions, projections, etc.).

Figure 14C:
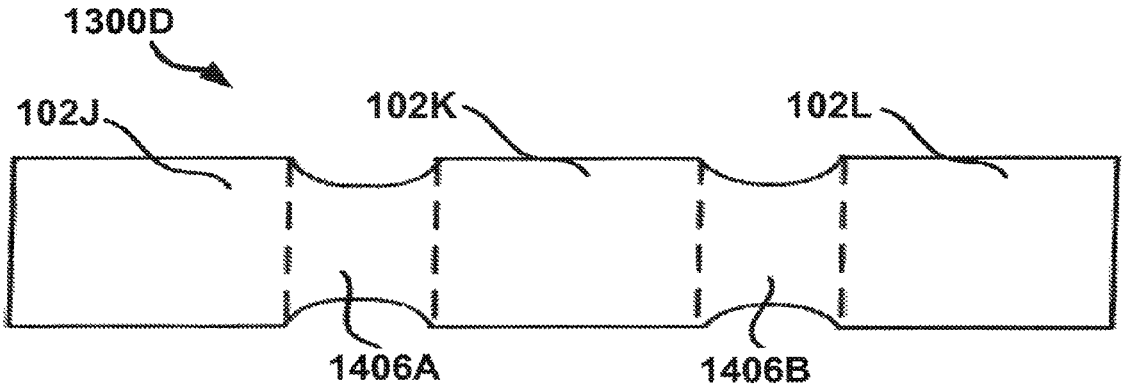
FIG. 14C is an end view diagram of an example of a composite cleaning head.

FIG. 14C is cross-sectional diagram of a composite cleaning head 1300D. The composite cleaning head 1300D may include cleaning heads 102J-L and flexible elements 1406A-B coupling cleaning heads 102J and 102K, and 102K and 102L, respectively. The cleaning heads 102J-L and flexible elements 1406A-B may all be formed from a single piece of flexible material. Such an embodiment may be called a "living hinge." Dashed lines are provided to denote for clarity what would normally be considered a side of a cleaning head 102.

The composite cleaning head 1300D can also resemble a living hinge in form with flexible elements 1406A-B that are not integral with the cleaning heads 102 but rather discrete flexible (hinge) elements 1406 affixed to two adjacent cleaning heads 102J and 102K or 102K and 102L. The discrete elements 1406 can include a length or width that is greater than their thickness or height.

Figure 15:
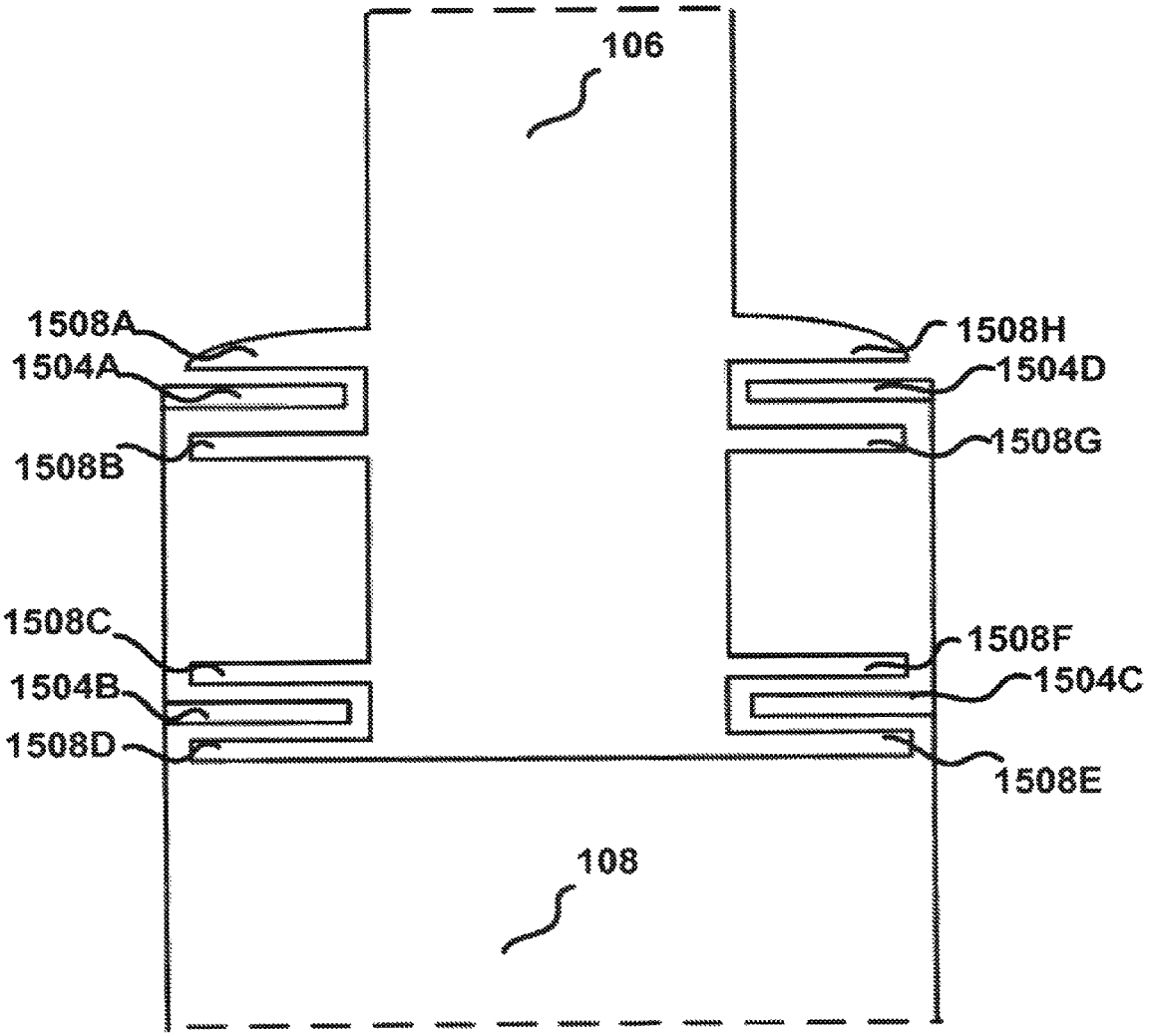
FIG. 15 is a cross-sectional diagram of an example of a neck element and handle coupling.

FIG. 15 is a cross-sectional diagram of an example of a handle 108 and neck element 106 coupling. The handle 108 may include handle inserts 1504A-D. The neck element 106 may include flanges 1508A-H. The handle inserts 1504 may be positioned between two directly adjacent neck flanges so as to prevent the neck element 106 from sliding substantially into or out of the handle 108 in a direction coaxial with the longitudinal axis of the apparatus. The neck flange 1508 and handle insert 1504 may function in concert to facilitate a neck element 106 to substantially pivot in response to rotational pressure or torqueing pressure. The ability of a neck element 106 to substantially pivot may reduce the stress on a part of the neck element. In addition, such pivoting may assist the cleaning head 102 attached to the neck element 106 to pivot when pressure is applied to the cleaning head 102.

Figure 16:
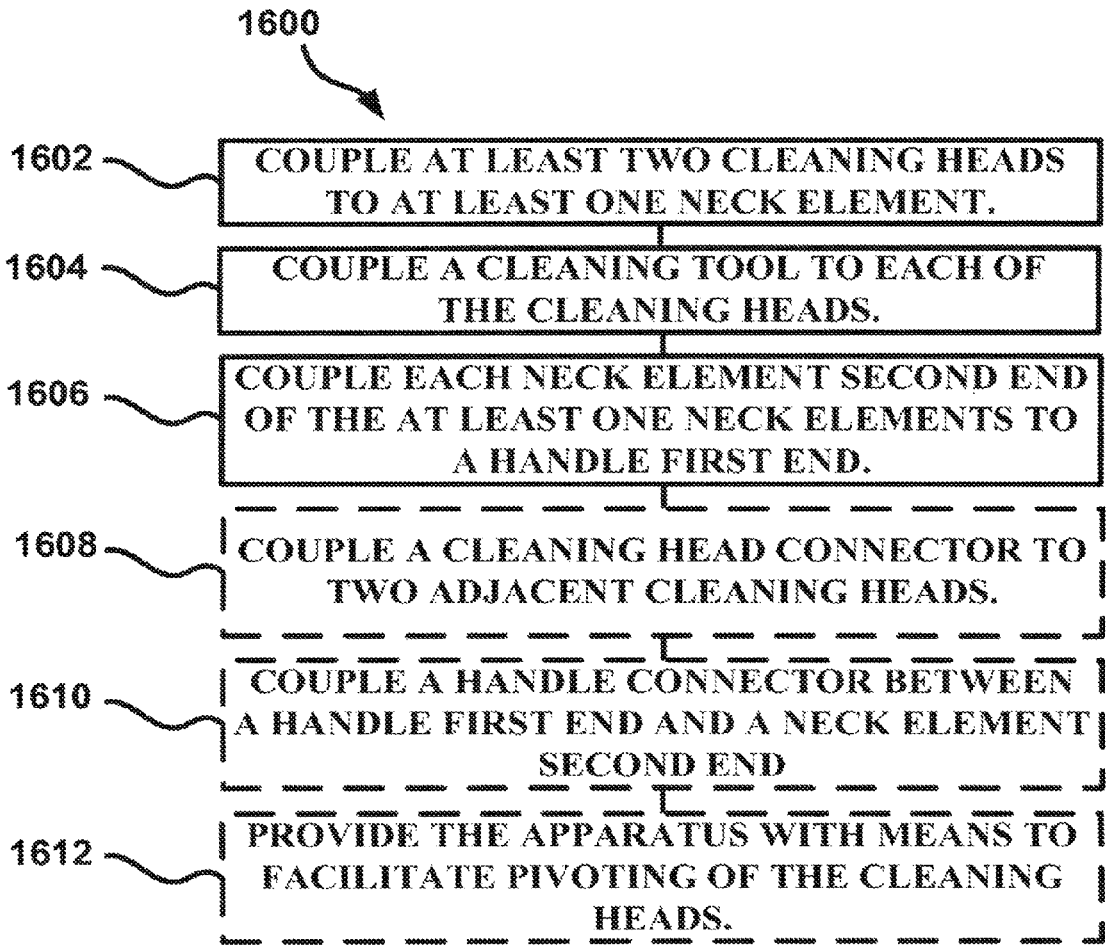
FIG. 16 is a flow diagram of an example of a method for manufacturing a cleaning apparatus.

FIG. 16 is a flow diagram of a method of manufacturing an apparatus 1600 according to an example embodiment. At 1602, at least two cleaning heads 102 may each be coupled to at least one neck element 106, respectively. In one or more embodiments, the coupling is between a cleaning head proximal portion and a neck element first end 118. In one or more embodiments first, second, and third neck elements 106A-C are coupled to first, second, and third cleaning heads 102A-C, respectively. At 1604 cleaning tools 104 are coupled to each of the cleaning heads 102. At 1606, neck element second ends 120 are coupled to a handle first end 116. The cleaning heads 102 may be arranged side-by-side along an axis that is substantially perpendicular to a longitudinal apparatus axis 126.

Steps 1608 through 1612 represent optional steps. The cleaning heads 102 may be arranged side-by-side along an axis that is substantially perpendicular to a longitudinal apparatus axis 126. At 1608, a flexible cleaning head connector 112 may be coupled to at least two adjacent cleaning heads, for example, 102A-B. At 1610 a flexible handle connector 114 may be coupled between a handle first end 116 and at least one neck element second end 118. At 1612, the apparatus may be provided with means to facilitate pivoting of one or more of the cleaning heads 102. This can include providing the apparatus with a handle insert 1504 and at least one individual neck element second end with at least two flanges 1508A-B. The handle insert 1504 can separate at least two adjacent individual neck element flanges 1508A-B. Means to facilitate at least one individual cleaning head 102 to pivot may be provided, wherein such means may include at least one selected from the group consisting of:

(a) a cleaning head body 102 and a stationary shaft 904 extending distally of a second neck end 120 and in a direction substantially perpendicular to the longitudinal axis of the composite cleaning head 124, the shaft 904 having a substantially half-round cross-section whose flat side faces the top side 110 of the cleaning head body 102 and the shaft 904 extending to a location within the cleaning head body 102 adjacent the distal portion of the cleaning head body 102, wherein the shaft 904 is disposed within a half-round channel portion 1022 located adjacent a widthwise cleaning head body 102 midline and on a side of said midline opposite the top side 110 of the cleaning head body 102, wherein the cleaning head body 102 has a second lengthwise channel portion 1042 disposed adjacent the widthwise cleaning head body midline and on a side of said midline opposite the bottom side of the cleaning head body 102, wherein the second channel portion 1042 has a cross-section shaped like a capital letter "M" whose left and right stems 1044 and 1046 each have a concave curve, wherein the terminus 911 of the capital letter "M" is provided with a pivoting piece 906, wherein the flat side of the shaft has a socket 907 disposed adjacent the pivoting piece 906 and configured to cooperate with the pivoting piece 906, wherein the shaft 904 has at least one flange 1032, at least one of which is substantially round and is located within the cleaning head body 102, and wherein the at least one substantially round flange 1032 located within the cleaning head body 102 is disposed within a substantially circumferential channel within the cleaning head body 102 that is configured to cooperate with the one or more flanges 1032 to restrain movement of the individual cleaning head in a direction coaxial with the shaft 904.

(b) the means described in (a) [supra], wherein there is no pivoting piece 906 coupled to the terminus 911 of the capital letter "M" and the terminus 911 is rounded.

(c) the means described in at least one of (a-b) [supra], wherein the shaft 904 has no socket 907.

(d) the means described in at least one of (a-c) [supra], wherein the terminus 911 of the capital letter "M" is pointed.

(e) a cleaning head body 102, a flexible connector 112 coupled to and interconnecting at least two laterally adjacent cleaning heads 102A-B, and a substantially round stationary shaft 904 extending distally of a second neck end 120 and in a direction substantially perpendicular to the longitudinal axis of the composite cleaning head 124, the shaft 904 extending to a location in between the proximal and the distal portions of the cleaning head body 102 and within the cleaning head body 102, wherein the shaft 904 is disposed within a substantially round lengthwise channel 910 in the cleaning head 102, wherein the shaft 904 has at least one substantially round flange 1032 that is round and located within the cleaning head body 102 and is disposed within a substantially circumferential channel within the cleaning head 102 that is configured to cooperate with the flange 1032 to restrain movement of the individual cleaning head 102 in a direction coaxial with the shaft 904.

(f) a cleaning head 102, a lengthwise hinge having a generally ball-and-socket profile (such as shown in FIGS. 14A-B) that connects at least two laterally adjacent individual cleaning heads 102A-B, and a stationary shaft 904 extending distally of a second neck end 120 and in a direction substantially perpendicular to the longitudinal axis of the composite cleaning head 124, the shaft 904 having a substantially round cross-section and the shaft 904 extending to a location in between the proximal and the distal portions of the cleaning head body 102 and disposed within the cleaning head body 102, wherein the shaft 904 is disposed within a substantially round lengthwise channel 910 in the cleaning head body 102, wherein the shaft 904 has at least one substantially round flange 1032 that is located within the cleaning head body 102 and is disposed within a substantially circumferential channel within the cleaning head body 102 that is configured to cooperate with the flange 1032 to restrain movement of the individual cleaning head 102 in a direction coaxial with the shaft 904.

(h) a cleaning head 102, a living hinge (such as shown in FIG. 14C) that connects at least two laterally adjacent cleaning heads 102A-B, and a stationary shaft 904 extending distally of a second neck end 120 and in a direction substantially perpendicular to the longitudinal axis of the composite cleaning head 124, the shaft 904 having a substantially round cross-section, the shaft 904 extending to a location in between the proximal and the distal portions of the cleaning head body 102 and disposed within the cleaning head body 102, wherein the shaft 904 is disposed within a substantially round lengthwise channel 910 in the cleaning head body 102, wherein the shaft 904 has at least one substantially round flange 1032 that is located within the cleaning head body 102 and disposed within a substantially circumferential channel within the cleaning head body 102 that is configured to cooperate with the flange 1032 to restrain movement of the individual cleaning head 102 in a direction coaxial with the shaft 904.

(i) the means described in at least one of (a-h) [supra], wherein the shaft 904 traverses the entirety of the cleaning head body 102 from an aperture 1206 at the proximal portion of the cleaning head body 102 to a cooperating aperture 1207 at the distal portion thereof, wherein the flanges 1032 are two in number, wherein a first flange 1032 is disposed external to and immediately adjacent the proximal portion of the cleaning head body 102 and a second flange 1032 is disposed external to and immediately adjacent the distal portion of the cleaning head 1032, and wherein the spacing of the flanges 1032 is such that they substantially prevent movement of the cleaning head 102 in a direction coaxial with the shaft 904 but do not prevent pivoting of the cleaning head 102.

(j) the means described in at least one of (a-h) [supra], wherein the shaft 904 traverses the entirety of the cleaning head body 102 from an aperture 1206 at the proximal portion of the cleaning head body 102 to a cooperating aperture 1207 at the distal portion thereof, wherein the flanges 1032 are three in number, wherein one of the three flanges 1032 is disposed within the cleaning head body 102 and two of the three flanges 1032 are disposed external to the cleaning head body 102, wherein a first external flange 1032 is disposed immediately adjacent the proximal portion of the cleaning head body 102 and a second external flange 1032 is disposed immediately adjacent the distal portion of the cleaning head 1032, and wherein the spacing of the flanges 1032 is such that they substantially prevent movement of the cleaning head 102 in a direction coaxial with the shaft 904 but do not prevent pivoting of the cleaning head 102.

(k) the shaft 904 extending from the proximal portion of the cleaning head 102 to the distal portion of the cleaning head 102, wherein the shaft 904 is disposed within a substantially round lengthwise channel 910 in the cleaning head 102, wherein the upper surface of the cleaning head 102 has a lengthwise substantially rectangular aperture 1204 open at the top and a cooperating cavity having the shape of an inverse isosceles trapezoid, wherein the channel 910 extends from a location distal the proximal portion of the cleaning head 102 to a location proximal the distal portion thereof and the channel 910 is open at the top, wherein the shaft 904 has a polyhedron-shaped protrusion 1106 extending upward and into the aperture 1204 of the cleaning head 102, wherein the shape of the protrusion 1106 is selected from one of the following: (i) an isosceles trapezoid polyhedron, (ii) an inverse isosceles trapezoid polyhedron, (iii) a rectangular polyhedron having a long axis coaxial with the longitudinal axis of the shaft 904, wherein its sides may optionally be concave or convex and the sides of the aperture 1204 have an opposite type of curve; (iv) a polyhedron having a triangular cross-section and a long axis coaxial with the longitudinal axis of the shaft 904, wherein its sides may optionally be concave or convex and the sides of the aperture 1204 have a complementary convex or concave curve; (v) a truncated ovaloid solid figure having a lengthwise axis coaxial with the longitudinal axis of the shaft 904, wherein the side portions of the truncated ovaloid solid figure are substantially convex and the sides of the aperture 1204 are substantially concave; and (vi) a substantially half-round solid figure having a lengthwise axis coaxial with the longitudinal axis of the shaft 904 and the flat side of which faces in the direction of the lower portion 1002A of the cleaning head 102, wherein the rounded portion of the substantially half-round figure extends into the aperture 1204 and the side portions of the aperture 1204 are substantially concave, wherein the planes of the two sides of the protrusion 1106 and the planes of the two sides of the aperture 1204 intersect to form acute angles, and wherein the shaft 904 has a first flange 1032A external to and adjacent the proximal portion of the cleaning head 102 and a second flange 1032B external to and adjacent the distal portion of the cleaning head 102.

(l) the means of (k) supra wherein the cooperating cavity has the shape of an inverse isosceles trapezoid.

(m) the means of either (k) or (l) [supra] wherein aperture 1204 extends from a location distal the proximal portion of the cleaning head 102 to a location proximal the distal portion of the cleaning head 102, the length of protrusion 1106 is slightly less than that of aperture 1204, and wherein coaxial movement of the cleaning head with respect to the longitudinal axis of the shaft is prevented by the end portions of the aperture contacting the end portions of the aperture.

(n) the means of (m) [supra] wherein shaft 904 has one flange external to and adjacent the proximal portion of the cleaning head and shaft 904 extends no farther than the distal most portion of aperture 1204.

(o) the means of (n) [supra] wherein shaft 904 has no flanges.

(p) the means described in at least one of (a-l) [supra] wherein at least two laterally adjacent cleaning heads 102A-B are connected by a flexible coupling of any type described herein.

(q) at least one handle insert 1504 and at least one individual neck element second end 118 provided with at least two flanges 1508, wherein at least two adjacent individual neck element flanges 1508A-B are separated by a handle insert 1504.

A cleaning apparatus (that is, any cleaning apparatus discussed herein or portrayed in the figures), according to one or more embodiments, may be configured to function as a toothbrush, a bathroom cleaning brush (e.g., a sink brush, a bathtub brush, a toilet brush, etc.), a cleaning implement having various other applications (e.g., a bathroom cleaning tool, a sink cleaning tool, a vehicle cleaning tool, etc.), a shower brush or body brush, an apparatus for cleaning broad surfaces, such as floors or walls; or a cleaning apparatus that can be adapted for applying liquid, fluid, and other non-solid substances to various surfaces.

In one or more embodiments, an apparatus comprises a handle having a first handle end, a neck component comprising at least two elastomeric individual neck elements each having a first neck end and a second neck end opposite the first neck end, the first neck end of each individual neck element coupled to the first handle end and the second neck element ends contiguous with a line substantially perpendicular to a longitudinal apparatus axis. The apparatus may further include a generally elongate composite cleaning head comprising at least two discrete individual cleaning heads, each including a first proximal portion coupled to a second neck end and a lower side provided with cleaning tools, the individual cleaning heads arranged substantially side-by-side and the composite cleaning head having a longitudinal profile that is substantially flat when the composite cleaning head is in normal or unstressed position, wherein the composite cleaning head responsively and reversibly deforms to accommodate curved and flat surfaces to be cleaned in response to force applied to the composite cleaning head in the direction of the surface to be cleaned. At least a portion of at least one individual neck element can be substantially inflexible.

ADDITIONAL EXAMPLES AND NOTES

In Example 1, a cleaning apparatus includes a handle comprising a first handle portion.

In Example 2, the cleaning apparatus of Example 1 includes at least two individual neck elements, wherein the at least two individual neck elements each include a first neck end and a second neck end opposite the first neck end, and wherein the second neck ends of the at least two individual neck elements are coupled to the first handle portion.

In Example 3, the cleaning apparatus of at least one of Examples 1-2 includes a composite cleaning head comprising at least two individual cleaning heads, wherein each of the individual cleaning heads includes a proximal portion connected to the first neck end of a one of the at least two individual neck elements and an opposing distal portion.

In Example 4, the individual cleaning heads of at least one of Examples 1-3 includes at least one cleaning tool coupled to its bottom side.

In Example 5, the cleaning tools of at least one of Examples 1-4 includes at least one of bristles, fibers, hair, filaments, wires, wool, abrasive material, pads, sponges, and a combination thereof.

In Example 6, the composite cleaning head of at least one of Examples 1-5 is configured to deform responsively and reversibly along its longitudinal plane in response to pressure applied in the direction of a surface to be cleaned, such that the cleaning tools can substantially conform to concave, convex, other non-planar surfaces, and planar surfaces, including planar and other surfaces having irregular features such as, for example, protrusions or recessions.

In Example 7, the individual cleaning heads of at least one of Examples 1-6 are arranged laterally adjacent to each other and along an axis substantially perpendicular to a longitudinal apparatus axis, and wherein a longitudinal profile of at least two laterally adjacent individual cleaning heads is substantially flat when the individual cleaning heads are in a non-stressed position.

In Example 8, at least one of the individual neck elements of at least one of Examples 1-7 includes a flexible portion.

In Example 9, the handle of at least one of Examples 1-8 includes at least one curve.

In Example 10, at least one individual neck element of the at least two individual neck elements of at least one of Examples 1-9 includes at least one curve.

In Example 11, at least one individual cleaning head of at least one of Examples 1-10 is flexibly coupled to the individual neck element.

In Example 12, at least one individual neck element of at least one of Examples 1-11 is flexibly coupled to the handle first portion.

In Example 13, the coupling of at least one individual neck element and the handle first portion of at least one of Examples 1-12 is configured to provide limited axial rotation of the individual neck element.

In Example 14, the apparatus of at least one of Examples 1-13 includes means for facilitating reversible responsive limited bi-directional pivoting about an axis substantially perpendicular to a longitudinal axis of the composite cleaning head of at least one individual cleaning head.

In Example 15, the apparatus of at least one of Examples 1-14 includes first, second, and third individual neck elements each coupled to an individual cleaning head.

In Example 16, the first individual neck element of at least one of Examples 1-15 is disposed substantially adjacent an apparatus longitudinal axis.

In Example 17, the second and third individual neck elements of at least one of Examples 1-18 are disposed laterally of the first neck element and on opposite sides of the first neck element.

In Example 18, the second and the third individual neck elements of at least one of Examples 1-17 each include a first neck element portion coupled to the first handle portion and a second neck element portion adjacent the first neck element portion.

In Example 19, the first individual neck element portions of the second and the third individual neck elements of at least one of Examples 1-18 each form an angle of between 60 degrees and 90 degrees with the longitudinal axis of the apparatus.

In Example 20, the second individual neck portions of the second and the third individual neck elements of Example 19 each form an angle of between 60 degrees and 90 degrees with longitudinal axes of the first individual neck portions of the second and the third individual neck elements.

In Example 21, the apparatus of at least one of Examples 1-20 is configured as a toothbrush.

In Example 22, the apparatus of at least one of Examples 1-20 is configured as a bath or shower brush.

In Example 23, the apparatus of at least one of Examples 1-20 is configured as a floor mop.

In Example 24, the apparatus of at least one of Examples 1-20 is configured as a push broom.

In Example 25, the apparatus of at least one of Examples 1-20 includes between two and four individual neck elements.

In Example 26, the apparatus of at least one of Examples 1-20 includes between two and four individual cleaning heads.

In Example 27, at least one individual neck element of at least one of Examples 1-26 differs in length from at least one other individual neck element.

In Example 28, at least one individual cleaning head of at least one of Examples 1-27 differs in width from at least one other individual cleaning head.

In Example 29, a method of manufacturing a cleaning apparatus configured to facilitate cleaning both planar and non-planar surfaces includes coupling each of at least two individual cleaning heads to one of at least two individual neck elements, the at least two individual cleaning heads and the corresponding individual neck elements coupled between an individual cleaning head proximal portion and an individual neck element first end.

In Example 30, the method of at least one of Examples 1-29 includes coupling at least one cleaning tool to the bottom side of at least one of the individual cleaning heads.

In Example 31, the method of at least one of Examples 29-30 includes coupling each individual neck element second end of the at least two individual neck elements to a first portion of a handle.

In Example 32, the method of at least one of Examples 29-31 includes arranging the individual cleaning heads laterally to each other to form a composite cleaning head having a longitudinal axis substantially perpendicular to a longitudinal apparatus axis.

In Example 33, the method of at least one of Examples 29-32 includes providing means for facilitating reversible responsive limited bi-directional pivoting about an axis substantially perpendicular to the longitudinal axis of the composite cleaning head of at least one individual cleaning head.

In Example 34, the method of at least one of Examples 29-33 includes coupling three individual cleaning heads and three individual neck elements, including coupling each individual cleaning head to a first, second, and third individual neck element, respectively, wherein the coupling is between an individual cleaning head proximal portion and an individual neck element first end of each of the individual neck elements.

In Example 35, the method of at least one of Examples 1-34 includes disposing a first individual neck element coaxially with an apparatus longitudinal axis, and disposing a second and a third individual neck element laterally to the first individual neck element and on opposite sides thereof.

In Example 36, the method of at least one of Examples 1-35 includes coupling the second and the third individual neck elements to the first handle portion at a first end of the second and third individual neck elements and forming an angle of between 60 degrees and 90 degrees with the longitudinal axis of the apparatus, wherein the second and third individual neck elements include a second portion adjacent to the first portion and form an angle of between 60 degrees and 90 degrees with the longitudinal axis of the first portions of the second and third individual neck elements.

In Example 37, a toothbrush includes a handle comprising a first handle portion.

In Example 38, the toothbrush of Example 37 includes at least two individual neck elements.

In Example 39, the at least two individual neck elements of Example 38 each include a first neck end and a second neck end opposite the first neck end.

In Example 40, the second neck ends of the at least two individual neck elements of Example 39 are coupled to the first handle portion.

In Example 41, the toothbrush of Example 40 includes a composite cleaning head including a plurality of individual cleaning heads.

In Example 42, each of the individual cleaning heads of Example 41 includes a proximal portion and an opposing distal portion.

In Example 43, the proximal portion of at least one of the individual cleaning heads of Example 42 is coupled to the first neck end of one of the at least two individual neck elements.

In Example 44, at least one of the individual cleaning heads of Example 43 includes at least one cleaning tool coupled to its bottom side.

In Example 45, at least two of the individual cleaning heads of Example 44 are arranged laterally and disposed adjacent to each other forming a composite cleaning head having a longitudinal axis substantially perpendicular to the longitudinal axis of the toothbrush and a substantially flat longitudinal plane when the composite cleaning head is in normal or unstressed position.

In Example 46, the bottom side of at least one of the individual cleaning heads of Example 45 is provided with cleaning tools.

In Example 47, the cleaning tools of at least one of Examples 1-46 include at least one of bristles, fibers, hair, filaments, wires, wool, abrasive material, pads, sponges, or a combination thereof.

In Example 48, the composite cleaning head is configured to deform responsively and reversibly along its longitudinal plane in response to pressure applied in the direction of a surface to be cleaned, such that the cleaning tools can substantially conform to concave, convex, other non-planar surfaces, irregular planar surfaces, and planar surfaces.

In Example 49, the apparatus of at least one of Examples 1-48 includes means for providing reversible responsive limited bi-directional pivoting about an axis substantially perpendicular to a longitudinal axis of the composite cleaning head of at least one individual cleaning head.

In Example 50, the apparatus of at least one of Examples 1-49 includes means for providing limited axial rotation of at least one individual neck element.

In Example 51, the apparatus of at least one of Examples 1-50 includes means for providing flexure of the coupling between at least one individual neck element and one individual cleaning head.

In Example 52, the apparatus of at least one of Examples 1-51 includes means for providing flexure of the coupling between at least one individual neck element and the first handle portion.

In Example 53, the apparatus of at least one of Examples 1-52 includes means for providing flexure of the coupling between two laterally adjacent individual cleaning heads.

In this document, the terms "a" or "an" are used, as is common in patent documents, to include one or more than one, independent of any other instances or usages of "at least one" or "one or more." In this document, the term "or" is used to refer to a nonexclusive "or," such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim is still deemed to fall within the scope of that claim. Moreover, in the following claims, the terms "first," "second," and "third," etc. are used merely as labels, and are not intended to impose numerical requirements on their objects.

Although an embodiment has been described with reference to specific example embodiments, it will be evident that various modifications and changes may be made to these embodiments without departing from the broader spirit and scope of the invention. Accordingly, the specification and drawings are to be regarded in an illustrative rather than a restrictive sense. The accompanying drawings that form a part hereof show by way of illustration, and not by way of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the disclosed subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose might be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

It will be readily understood to those skilled in the art that various other changes in the details, material, and arrangements of the parts and method stages which have been described and illustrated in order to explain the nature of the inventive subject matter may be made without departing from the principles and scope of the inventive subject matter as expressed in the subjoined claims.

What is claimed is:

1. A cleaning apparatus comprising:

a handle comprising a first handle portion;

three individual neck elements, wherein the individual neck elements each include a first neck end and a second neck end opposite the first neck end, and wherein the second neck ends of the individual neck elements are coupled to and extend distally of the first handle portion; and an elongate composite cleaning head comprising three individual cleaning heads, the composite cleaning head having a longitudinal axis substantially perpendicular to a longitudinal apparatus axis, first and second ends and disposed on opposing sides of the longitudinal apparatus axis, and a longitudinal plane extending between the first and second ends;

wherein each of the individual cleaning heads includes a longitudinal plane substantially coplanar with the composite cleaning head longitudinal plane, a transverse plane, a longitudinal axis substantially perpendicular to the longitudinal apparatus axis and coaxial with the composite cleaning head longitudinal axis, a transverse axis substantially perpendicular to the individual cleaning head longitudinal axis, top and bottom sides, a proximal portion connected to the first neck end of one of the individual neck elements and an opposing distal portion, first and second lateral portions disposed on opposing sides of the transverse axis, and a lengthwise dimension extending substantially from the proximal portion substantially to the distal portion wherein each of the individual cleaning heads includes at least one cleaning tool coupled to its bottom side, and wherein at least one of the cleaning tools of each individual cleaning head includes at least one of bristles, fibers, hair, filaments, wires, wool, abrasive material, pads, sponges, or a combination thereof;

wherein the three individual cleaning heads are disposed along the composite cleaning head longitudinal axis in a side-by-side laterally adjacent arrangement wherein their facing lateral portions are in substantially parallel planar relationship, and the portions of the cleaning tools which contact a surface to be cleaned have a combined longitudinal profile substantially flat when in a non-stressed position and face in substantially the same direction with respect to the lateral plane of the composite cleaning head; and wherein the composite cleaning head is configured to deform responsively and reversibly along its longitudinal plane in response to pressure applied in the direction of a surface to be cleaned in such a way that the cleaning tools effectively contact concave, convex, other non-planar surfaces, and regular and irregular planar surfaces.

2. The cleaning apparatus of claim 1, wherein at least a portion of at least one of the individual neck elements is resilient.

3. The cleaning apparatus of claim 1, wherein the gripping portion of the handle includes at least one curve.

4. The cleaning apparatus of claim 1, wherein at least one individual neck element includes at least one curve.

5. The cleaning apparatus of claim 1, wherein a first individual neck element is disposed substantially coaxially with an apparatus longitudinal axis and a second and a third individual neck element are disposed laterally thereof on opposite sides thereof, wherein the second and the third individual neck elements each include a first neck element portion coupled to the first handle portion and a second neck element portion adjacent the first neck element portion, and wherein the longitudinal axes of the first individual neck element portions of the second and the third individual neck elements each form an angle of between 60 degrees and 90 degrees with the longitudinal axis of the apparatus and the longitudinal axes of the second individual neck portions of the second and the third individual neck elements each form an angle of between 60 degrees and 90 degrees with the longitudinal axes of the first individual neck portions of the second and the third individual neck elements.

6. The cleaning apparatus of claim 5, wherein at least one individual cleaning head differs in width from at least one other individual cleaning head in one or more of the following characteristics: overall shape; width as measured along a dimension collinear with the composite cleaning head longitudinal axis; or length as measured along the lengthwise dimension of the individual cleaning head.

7. The cleaning apparatus of claim 1, wherein the apparatus is configured as a toothbrush for cleaning the teeth and other parts of the oral cavity of a child or an adult.

8. The cleaning apparatus of claim 1, wherein the apparatus is configured for at least one of the group including combing, brushing, or grooming.

9. The apparatus of claim 8, wherein the dimensions of the cleaning apparatus are such that the apparatus can effectively be used for combing, brushing, or grooming, combing, and otherwise.

10. The cleaning apparatus of claim 1, wherein the apparatus is configured as a cleaning apparatus for cleaning broad surfaces.

11. The cleaning apparatus of claim 1, further comprising means for permitting at least one of:

(a) reversible responsive limited bi-directional pivoting about an axis substantially perpendicular to the longitudinal axis of the composite cleaning head of at least one individual cleaning head;

(b) reversible responsive limited axial rotation of at least one individual neck element, the rotation facilitated by the provision of a mechanical coupling;

(c) flexion of the coupling between at least one individual neck element and one individual cleaning head, the flexion facilitated by a resilient element connecting the two components;

(d) flexion of the coupling between at least one individual neck element and the first handle portion, the flexion facilitated by a resilient element connecting the two components;

(e) responsive relative movement of the coupling between two laterally adjacent individual cleaning heads, the flexion facilitated by a resilient or a mechanical linkage connecting the two components; and (f) a combination thereof.

12. The cleaning apparatus of claim 1, wherein the apparatus is configured as a cleaning apparatus for cleaning bathroom fixtures.

13. The cleaning apparatus of claim 1, wherein the handle includes one or more portions that are non-coaxial with the longitudinal axis of the apparatus.

14. A toothbrush for cleaning the teeth and other parts of the oral cavity of a child or an adult, the toothbrush comprising:

a handle comprising a first handle portion;

three individual neck elements, wherein the individual neck elements each include a first neck end and a second neck end opposite the first neck end, and wherein the second neck ends of the individual neck elements are coupled to and extend distally of the first handle portion; and an elongate composite cleaning head comprising three individual cleaning heads, the composite cleaning head having a longitudinal axis substantially perpendicular to a longitudinal apparatus axis, first and second ends and disposed on opposing sides of the longitudinal apparatus axis, and a longitudinal plane extending between the first and second ends;

wherein each of the individual cleaning heads includes a longitudinal plane substantially coplanar with the composite cleaning head longitudinal plane, a transverse plane, a longitudinal axis substantially perpendicular to the longitudinal apparatus axis and coaxial with the composite cleaning head longitudinal axis, a transverse axis substantially perpendicular to the individual cleaning head longitudinal axis, top and bottom sides, a proximal portion connected to the first neck end of one of the individual neck elements and an opposing distal portion, first and second lateral portions disposed on opposing sides of the transverse axis, and a lengthwise dimension extending substantially from the proximal portion substantially to the distal portion;

wherein each of the individual cleaning heads includes at least one cleaning tool coupled to its bottom side, and wherein at least one of the cleaning tools of each individual cleaning head includes at least one of bristles, fibers, hair, filaments, wires, wool, abrasive material, pads, sponges, or a combination thereof;

wherein the three individual cleaning heads are disposed along the composite cleaning head longitudinal axis in a side-by-side laterally adjacent arrangement wherein their facing lateral portions are in substantially parallel planar relationship, and the portions of the cleaning tools which contact a surface to be cleaned have a combined longitudinal profile substantially flat when in a non-stressed position and face in substantially the same direction with respect to the lateral plane of the composite cleaning head; and wherein the composite cleaning head is configured to deform responsively and reversibly along its longitudinal plane in response to pressure applied in the direction of a surface to be cleaned in such a way that the cleaning tools effectively contact concave, convex, other non-planar surfaces, and regular and irregular planar surfaces.

15. The toothbrush of claim 14, further comprising means for permitting at least one of:

(a) reversible responsive limited bi-directional pivoting about an axis substantially perpendicular to the longitudinal axis of the composite cleaning head of at least one individual cleaning head;

(b) reversible responsive limited axial rotation of at least one individual neck element, the rotation facilitated by the provision of a mechanical coupling;

(c) flexion of the coupling between at least one individual neck element and one individual cleaning head, the flexion facilitated by a resilient element connecting the two components;

(d) flexion of the coupling between at least one individual neck element and the first handle portion, the flexion facilitated by a resilient element connecting the two components;

(e) responsive relative movement of the coupling between two laterally adjacent individual cleaning heads, the flexion facilitated by a resilient or a mechanical linkage connecting the two components; and (f) a combination thereof.

16. The toothbrush of claim 14, wherein the handle includes one or more portions that are non-coaxial with the longitudinal axis of the apparatus.

17. A cleaning apparatus comprising:

a handle comprising a first handle portion;

at least three individual neck elements, wherein the individual neck elements each include a first neck end and a second neck end opposite the first neck end, and wherein the second neck ends of the individual neck elements are coupled to and extend distally of the first handle portion; and an elongate composite cleaning head comprising at least three individual cleaning heads, wherein the number of individual cleaning heads is identical to the number of individual neck elements, the composite cleaning head having a longitudinal axis substantially perpendicular to a longitudinal apparatus axis, first and second ends disposed on opposing sides of the longitudinal apparatus axis, and a longitudinal plane extending between the first and second ends;

wherein each of the individual cleaning heads includes a longitudinal plane substantially coplanar with the composite cleaning head longitudinal plane, a transverse plane, a longitudinal axis substantially perpendicular to the longitudinal apparatus axis and coaxial with the composite cleaning head longitudinal axis, a transverse axis substantially perpendicular to the individual cleaning head longitudinal axis, top and bottom sides, a proximal portion connected to the first neck end of one of the individual neck elements and an opposing distal portion, first and second lateral portions disposed on opposing sides of the transverse axis, and a lengthwise dimension extending substantially from the proximal portion substantially to the distal portion;

wherein each of the individual cleaning heads includes at least one cleaning tool coupled to its bottom side, and wherein at least one of the cleaning tools of each individual cleaning head includes at least one of bristles, fibers, hair, filaments, wires, wool, abrasive material, pads, sponges, or a combination thereof;

wherein the at least three individual cleaning heads are disposed along the composite cleaning head longitudinal axis in a side by side laterally adjacent arrangement wherein their facing lateral portions are in substantially parallel planar relationship, and the portions of the cleaning tools which contact a surface to be cleaned have a combined longitudinal profile substantially flat when in a non-stressed position and face in substantially the same direction with respect to the lateral plane of the composite cleaning head; and wherein the composite cleaning head is configured to deform responsively and reversibly along its longitudinal plane in response to pressure applied in the direction of a surface to be cleaned in such a way that the cleaning tools effectively contact concave, convex, other non-planar surfaces, and regular and irregular planar surfaces.

18. The cleaning apparatus of claim 17, wherein the apparatus is configured as a toothbrush.

* * * * *